US007524200B2

(12) United States Patent
Ikeya et al.

(10) Patent No.: US 7,524,200 B2
(45) Date of Patent: Apr. 28, 2009

(54) LEVER TYPE CONNECTOR

(75) Inventors: Kenichi Ikeya, Shizuoka-ken (JP); Ronald Alan Cabangal, Shizuoka-ken (JP); Hideki Inoue, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/925,470

(22) Filed: Oct. 26, 2007

(65) Prior Publication Data

US 2008/0102668 A1 May 1, 2008

(30) Foreign Application Priority Data

Oct. 27, 2006 (JP) ..... P2006-292325

(51) Int. Cl.
*H01R 11/20* (2006.01)

(52) U.S. Cl. ..... 439/157

(58) Field of Classification Search ..... 439/157
See application file for complete search history.

(56) References Cited

U.S. PATENT DOCUMENTS 6,666,697 B2 * 12/2003 Yamashita ..... 439/157

FOREIGN PATENT DOCUMENTS

JP 2002-216894 8/2002

* cited by examiner

*Primary Examiner*—Truc T Nguyen
(74) *Attorney, Agent, or Firm*—Finnegan, Henderson, Farabow, Garrett & Dunner, L.L.P.

(57) ABSTRACT

A lever type connector comprises two connector housings, a lever which is rotatably attached to one housing and has cam grooves, and cam pins which are provided on another housing and guided by the cam grooves. Connecting or disconnecting is assisted by rotating the lever with the cam pins and the cam grooves. Guiding structure is provided between the first and second connector housings for guiding the cam pins to entry gates of the cam grooves respectively as connection of the first and second connector housings proceeds at an initial stage of the connection. According to the lever type connector, the cam pins is guided properly to the entry gates of the cam grooves of the lever at the initial stage of the connection.

5 Claims, 21 Drawing Sheets

LEVER TYPE CONNECTOR

BACKGROUND OF THE INVENTION

1. Field of the Invention

The present invention relates to a lever type connector in which male and female connector housings can be connected or disconnected by rotating a lever with only a small operating force.

2. Description of the Related Art

Conventionally, for a connector which requires a large connecting force such as a multi-terminal connector, a lever type connector having a lever for assisting the connecting force has been utilized. In the lever type connector, a lever having a cam groove on one connector housing (for example, a male connector housing) is rotatably provided, and a cam pin to be guided by the cam groove is provided on another connector housing (for example, a female connector housing). The cam pin is inserted into an entry gate of the cam groove at an initial stage of connecting both connector housings where a lever is positioned at a start position. Next, the cam pin is guided into the can groove by rotating the lever, and then the both housings are firmly connected with a small operating force of the lever by utilizing the principle of leverage.

FIG. 1 and FIG. 2 show one embodiment of a conventional lever type connector described in Japanese Patent Application Laid Open No. 2002-216894. FIG. 1 shows a state before a cam pin is inserted into a cam groove. FIG. 2 shows a state in which the cam pin is inserted into the cam groove and fixed.

This lever type connector has a pair of male and female connector housings 910 and 950 to be connected with each other. In each terminal cavity of the connector housings 910 and 950, terminals (not shown in figures) are accommodated. The arch-shaped lever 930 for connecting operation is attached to the connector housing 910 at outer side surface of one connector housing. An axial hole 932 and the cam groove 940 are formed on each base end of the lever 930. A knob 949 is formed on a center of the lever 930.

Each of the cam grooves 940 extends in a prescribed angle range around the axial hole 932 (center of the angle). A distance from the axial hole 932 to the cam groove 940 decreases gradually from an entry gate 941 towards an opposite end. A pin 912, to which the axial hole 932 is rotatably coupled, is provided on each side of the connector housing 910. The lever 930 is rotatably attached by coupling the pins 912 with the axial holes 932 respectively. As a result, the lever 930 will be rotated around the pin 912 (center of the rotation) between start and end positions.

The cam pin 955 to be guided by the cam groove 940 of the lever 930 is provided on each side of the connector housing 950. When a pair of the connector housings 910 and 950 is to be connected, the cam pin 955 is positioned near the entry gate 941 of the cam groove 940 of the lever 930 positioned at the start position. FIG. 21 shows a state in which the cam pin 940 has been slightly entered into the cam grooves 940 through the entry gate 941.

A notch 942 is provided on an inner edge of the respective cam groove 940 near the entry gate 941 for temporarily holding the cam pin 955 which has entered through the entry gate 941. A pawl 943 is provided on an entry side of the respective notch 942 for holding the cam pin 955. Therefore, the cam pins 955 are held by the notches 942 respectively in an initial stage of connecting and then the connector housings are temporarily locked for preventing disconnecting.

When the pair of the connector housings 910, 950 is loosely connected with the lever 930 positioned at the start position, the respective cam pin 955 is inserted into the entry gate 941 of the respective cam groove 940 and held by the respective notches 942. And then, the lever 930 is rotated toward the end position by grabbing the knob 949. The respective cam pin 955 is entered into the cam groove 940 deeply. The connector housings 910, 950 are connected by the cam structure between the cam groove 940 and the cam pin 955.

On the contrary, the lever 930 is rotated in an opposite direction when the both connector housings 910, 950 are to be disconnected. The both connector housings 910, 950 will be disconnected by the principle of leverage applied between the cam groove 940 and the cam pin 955.

In the above-described lever type connector, it is needed to fit positions of the respective entry gate 941 and the respective cam pin 955 when the both connector housings 910, 950 are to be connected temporarily. However, if connecting potions of the both connector housings 910, 950 have much looseness, much work for fitting the positions must be needed and then connecting workability must be reduced.

SUMMARY OF THE INVENTION

In view of the above-described situation, the present invention has an object to provide a lever type connector which is capable of entering cam pins into cam grooves easily at temporarily connecting a pair of connector housings even when connecting potions of both connector housings have much looseness and improving connecting workability.

An aspect of the present invention provides a lever type connector which comprises: first and second connector housings to be connected with each other; a lever which is rotatably attached to the first connector housing and has cam grooves; and cam pins which are provided on the second connector housing and guided by the cam grooves respectively. Connecting or disconnecting of the first and second connector housings is assisted by rotating the lever in a state where the cam pins are inserted into the cam grooves respectively. Guiding structure is provided between the first and second connector housings for guiding the cam pins to entry gates of the cam grooves respectively as connection of the first and second connector housings proceeds at an initial stage of the connection.

According to the aspect of the present invention, the cam pins is guided properly to the entry gates of the cam grooves of the lever at the initial stage of the connection even when connecting potions of the female and male connector housings have much looseness. Therefore, the female and male connector housings can be completely connected smoothly only by rotating the lever under initial connecting of the female and male connector housings.

It is preferable that the lever type connector includes a pair of side panels, the pair of side panels includes the cam grooves respectively and rotatably coupled with a pair of sidewalls of the first connector housing respectively, the entry gates of the cam grooves open at circumferential edges of the pair of the side panels respectively, the cam pins are projected from a pair of sidewalls of the second connector housing respectively, the guiding structure includes a pair of frictioning portions which is to be frictioned each other as the connection proceeds at the initial stage to align a relative position in a first direction between the first and second connector housings in order to guide the cam pins to entry gates of the cam grooves respectively, the first direction being perpendicular to a connecting direction of the first and second connector housings, and the pair of frictioning portions includes guiding slopes facing toward the first direction respectively.

In this way, the female and male connector housings can be aligned in the first direction by the guiding slopes at the initial connecting stage. Therefore, the cam pins can be guided properly to the entry gates of the cam grooves respectively.

Here, it is further preferable that the lever type connector further comprises temporary connecting structure for connecting the first and second connector housings temporarily at the initial stage is provided between the first and second connector housings. The temporary connecting structure includes a pair of engaging planes which is to be engaged each other to connect the first and second connector housings temporarily. The pair of frictioning portions is disposed forward the pair of engaging planes in the connecting direction respectively. The temporary connecting structure includes at least one arm which includes one frictioning portion and one engaging plane and has elastic restoring feature in the first direction.

In this way, the female and male connector housings can be aligned in the connecting direction when the female and male connector housings are connected temporarily by the temporary connecting structure, and an aligned position between the female and male connector housings can be held. Therefore, the cam pins, which have been guided to the entry gates of the cam grooves respectively, can be entered the cam grooves smoothly only by rotating the lever under temporary connecting of the female and male connector housings. The complete connection of the female and male connector housings can be done by cam structure.

Here, it is further preferable that the lever type connector further comprises temporary holding structure which is provided between the lever and the female connector housing and holds the lever temporarily at a start position of rotation. The temporary holding structure is configured to release temporary holding of the lever when the temporary connecting structure connects the first and second connector housings temporarily.

In this way, since temporary holding of the lever is released when the female and male connector housings are connected temporarily by the temporary connecting structure, complete connection of the female and male connector housings can be done immediately only by rotating the lever. In other words, the lever can be held until the connector housings are temporarily connected, and can be rotated only after the connector housings are temporarily connected. Therefore, operating status (held or rotatable) of the lever can be changed without the need of a special operation, and then connecting workability can be improved effectively.

Here, it is further preferable that the temporary holding structure includes a pair of holding projections provided on inner side of the pair of side panels respectively and a pair of holding holes provided on the pair of sidewalls of the first connector housing respectively for engaging the pair of holding projections respectively, the temporary connecting structure includes a pair of projecting tabs projected from the pair of sidewalls of the second connector housing respectively, and the temporary holding structure is configured to release temporary holding of the lever when the pair of projecting tabs pushes the pair of holding projections being engaged with the pair of holding holes outward respectively.

Here, it is also further preferable that the pair of holding projections includes guiding slopes facing a second direction which is perpendicular to both the connecting direction and the first direction, and the guiding slopes of the pair of holding projections is to be frictioned with the pair of projecting tabs at the initial stage to align a relative position in the second direction between the first and second connector housings.

In these ways, the female and male connector housings can be aligned in the second direction at the initial connecting stage by the elastic restoring forces of the lever. Therefore, the cam pins can be guided properly to the entry gates of the cam grooves respectively and the complete connection can be done smoothly by rotating the lever.

DESCRIPTION OF THE PREFERRED EMBODIMENT

Figure 1:
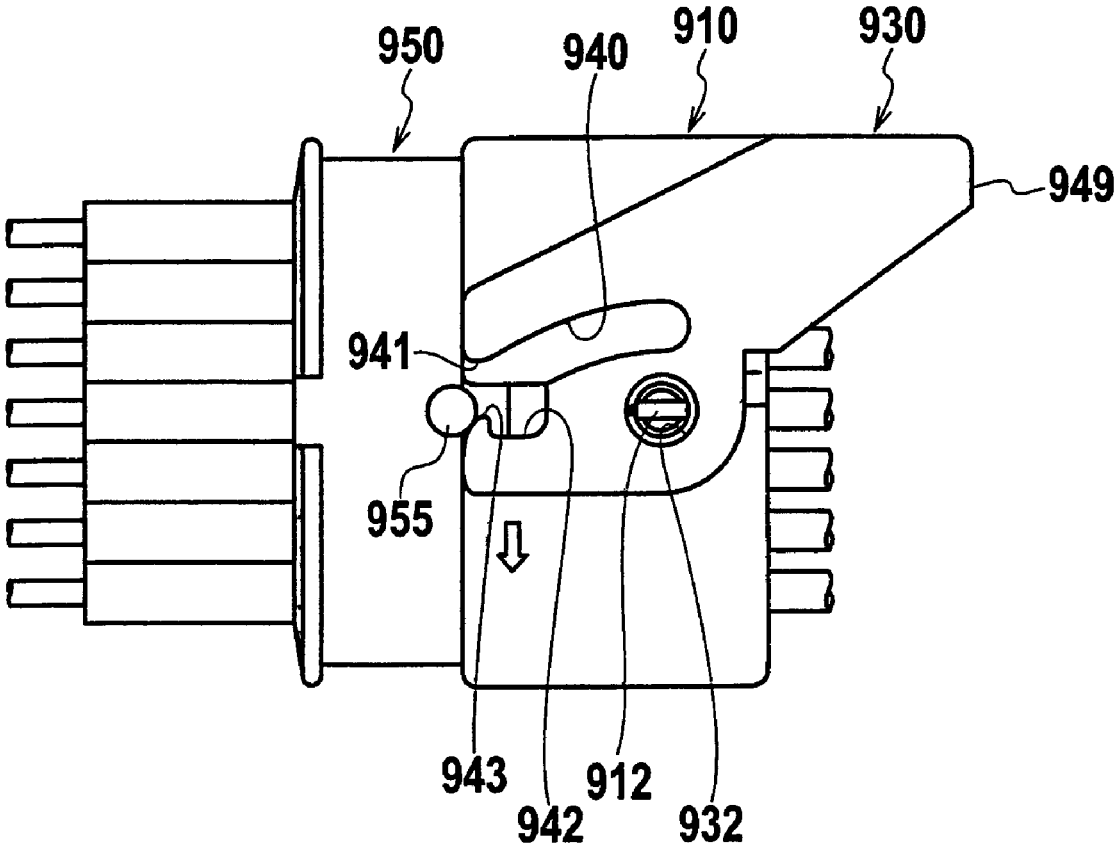
FIG. 1 PRIOR ART
FIG. 1 is a side view showing one example of a conventional lever type connector (a state before a cam pin is inserted into a cam groove)
Figure 2:
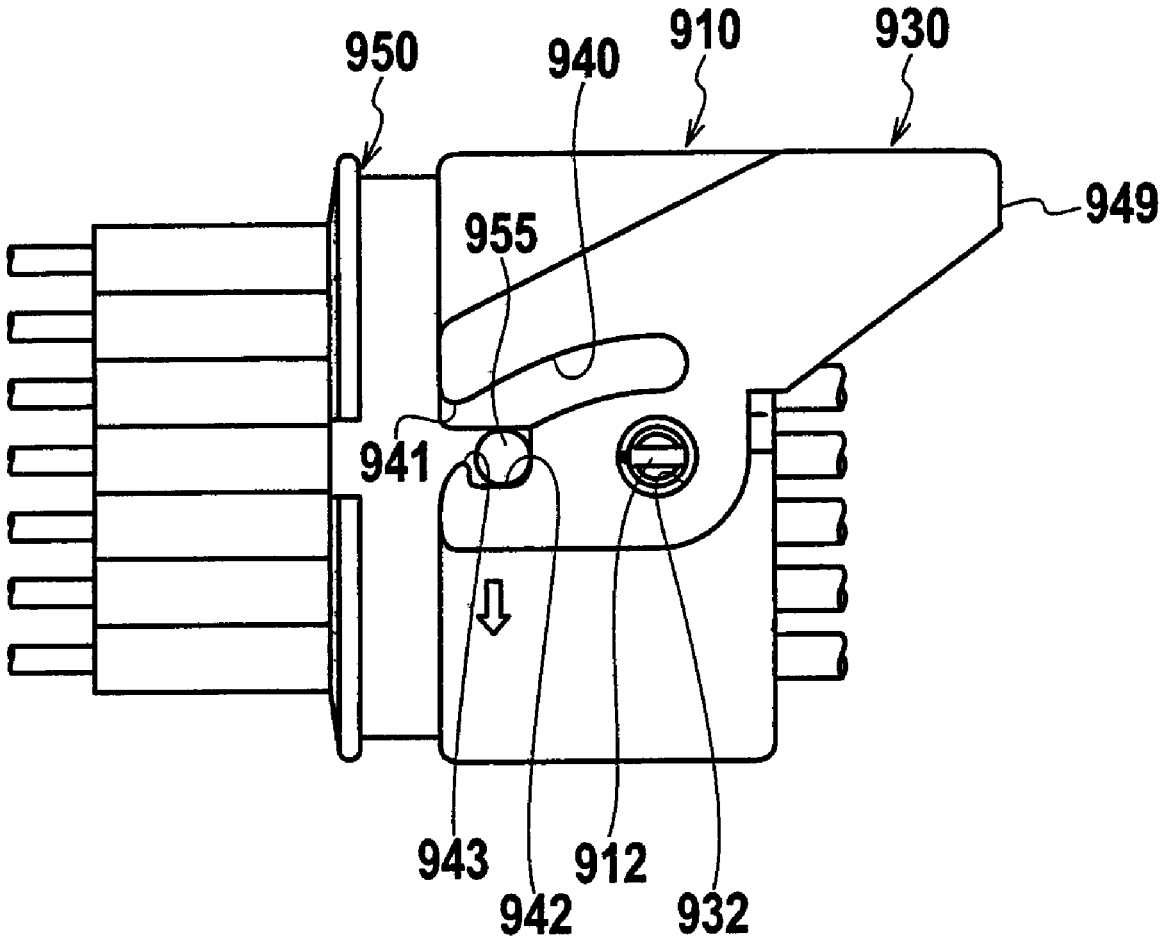
FIG. 2 PRIOR ART
FIG. 2 is a side view showing the example of a conventional lever type connector (an initial stage of connecting in which a cam pin is inserted into a cam groove)

In the following, an embodiment of the present invention will be described with references to the drawings.

A lever type connector of this embodiment mainly comprises a female connector 100, a male connector 200, a front holder 300, a movable plate (movable guide member) 400, a lever 500, and a cover 600. The female connector 100 and the male connector 200 are to be connected with each other. The front holder 300 is attached inside a front aperture 102 of a housing (female connector housing) 101 of the female connector 100.

The movable plate 400 is attached inside a hood 202 of a connector housing (male connector housing) 201 of the male connector 200. The movable plate 400 is attached inside a front aperture 202*a* of the hood 202 and slidable in a connecting direction (a forward and backward direction) within the food 202. The lever 500 is attached to an outer side of the female connector 100. The cover 600 is attached to the female connector 100 in order to cover a backside of the female connector 100.

Female terminals (not shown in the figures) are installed within a cavity of the female connector housing 101. The hood 202 of the male connector 200 is inserted inside the front aperture 102 of the female connector housing 101. Each connecting portions of the female and male connector housings 101, 201 has an almost vertically long rectangle shape with being viewed from respective front side. Both right and left sidewalls of the food 202 of the male connector housing 201 are to be inserted within both right and left sidewalls of the female connector housing 101.

In addition, the female terminals, each of which is prevented from pulling-out by its lance (another holding structure), are unfailingly held by the front holder 300 attached to the female connector 100 from its front side. Each of the female terminals is doubly held by its lance and the front holder 300.

Furthermore, male terminals (not shown in the figures) are insalled within a cavity of the male connector housing 201. The hood 202, which is extending towards a front side, is inserted inside the front aperture 102 of the female connector 100. The metallic terminals, each of which is held by its lance, is protected by the movable plate 400 installed slidably within the hood 202 of the male connector 200 from its front side. The female terminals are electrically connected with the corresponding male terminals respectively when the female and male connectors 100, 200 have been connected completely.

Figure 3:
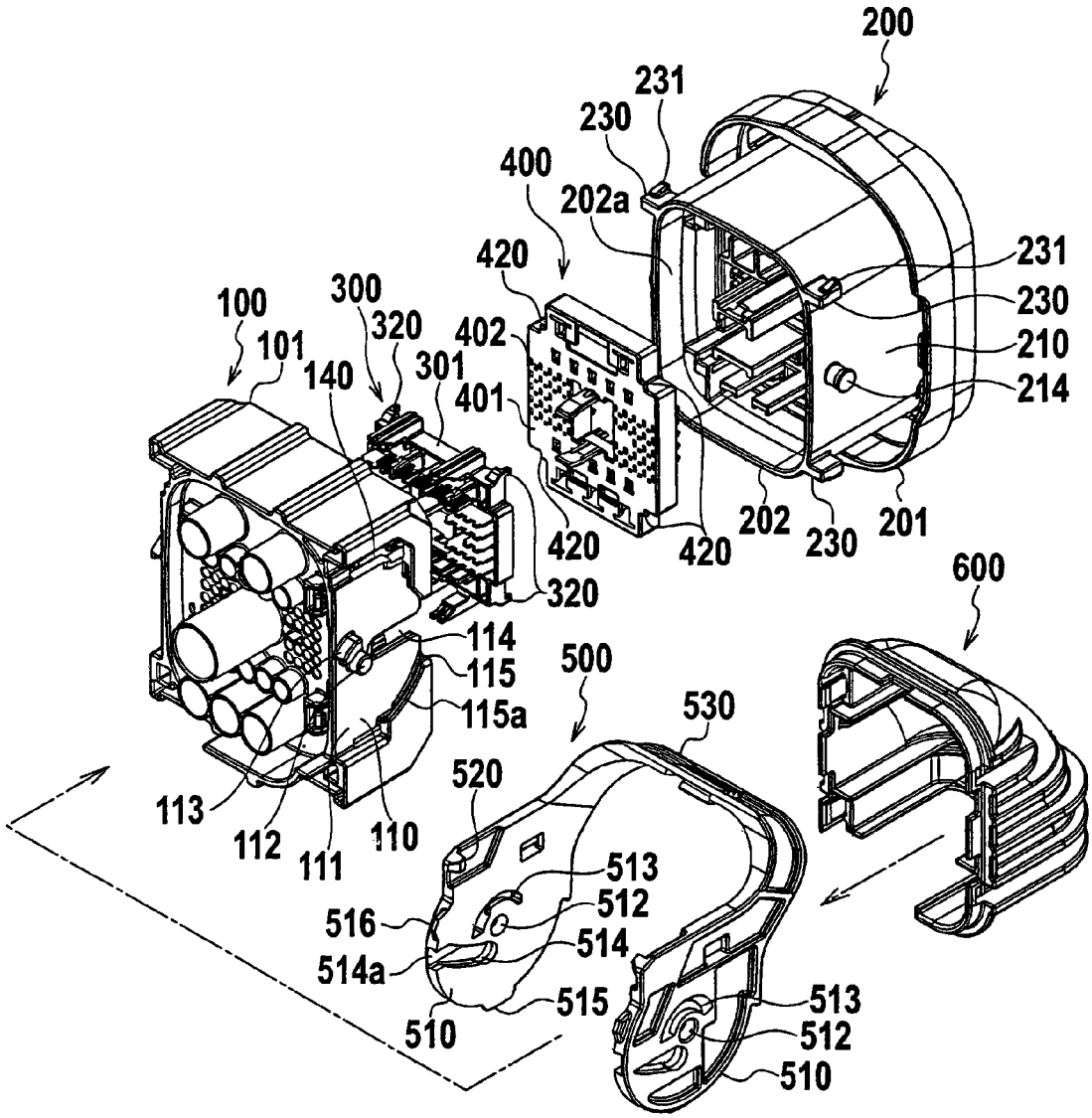
FIG. 3 is an exploded perspective view of a lever type connector of one embodiment of the present invention.
Figure 4:
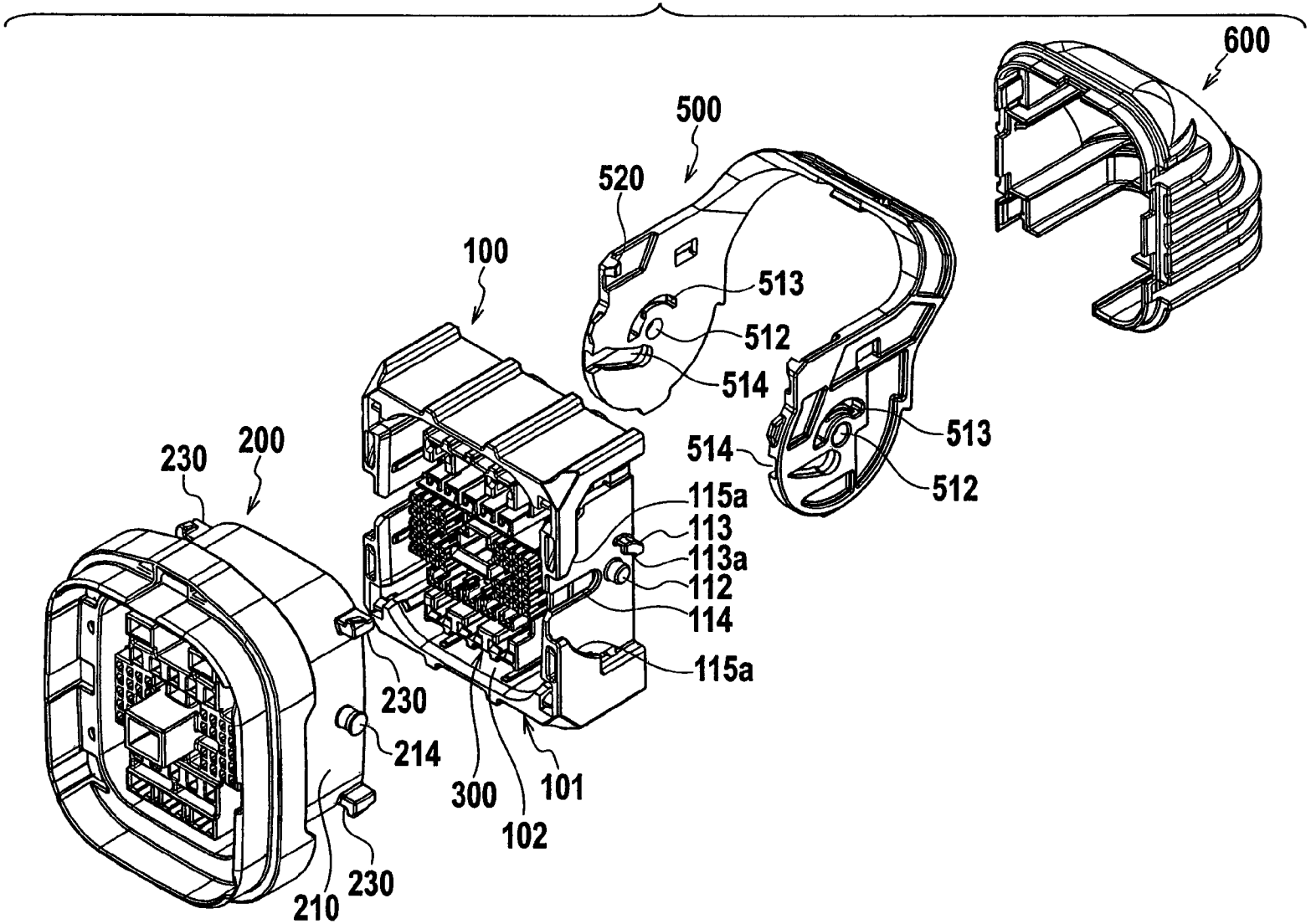
FIG. 4 is an exploded perspective view showing the lever type connector of the embodiment (a pair of connector housings are viewed from different angle from FIG. 3)
Figure 5:
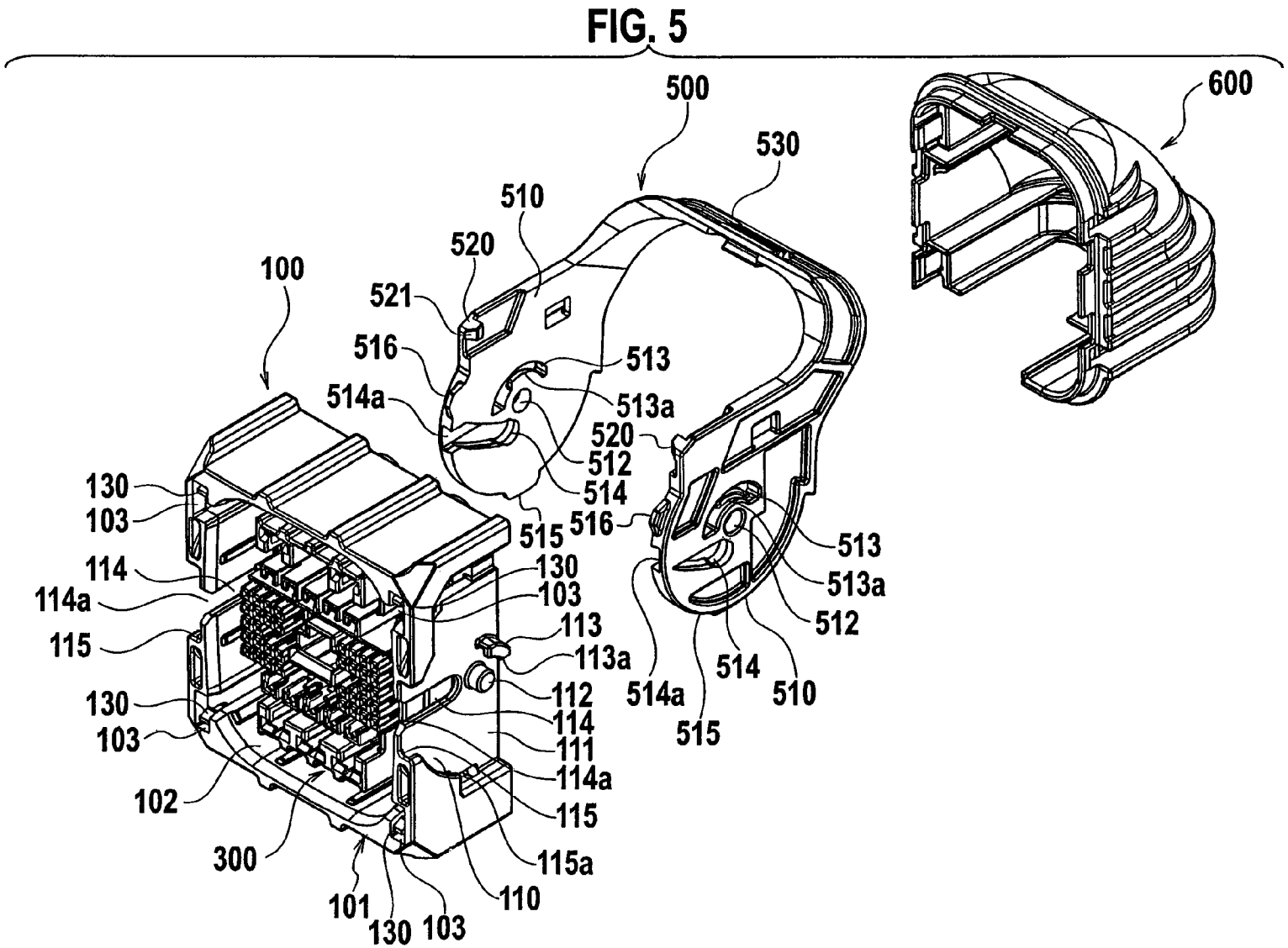
FIG. 5 is an exploded perspective view showing a configuration of a female connector of the embodiment.

As shown in FIG. 3, the movable plate 400 is made by forming a plurality of thorough holes on a main plate 401 in order to guide the male terminals. The movable plate 400 holds the male terminals of the male connector 200 at their regular positions while connecting with the female terminals in order to prevent deformation of distal ends of the male terminals. Furthermore, the movable plate 400 is slid towards from a temporarily connecting position in a frontside to a completely connecting position in a backside by being pushed by the female connector 100 in order to guide the connecting between the female and mail terminals.

As shown in FIG. 3 and FIGS. 19 to 21, hooking tabs (engaging portions) 420 are formed on the movable plate 400 for a temporary connection of the pair of the connector housings. In addition, barbed arms 220 are also formed inside the male connector housing 201 for the temporary connection. Each of the barbed arms 220 can bend with its elastic deflection.

Furthermore, release projections 320 for releasing the temporary connection are provided on each corners of a rectangle plate 301 of the front holder 300, which is inserted into the female connector 200 and fixed thereon. The respective barbed arms 220 are bent toward a release direction when the respective barbed arms 220 contact with the respective release projections 320, and then respective temporary engagements between the barbed arms 220 and the hooking tabs 400 are released.

Each of the barbed arms 220 includes a pawl 221 on its distal end, a first slope 222 and a second slope 223. The pawl 221 is engaged with the hooking tab 420 of the movable plate 400 in order to engage the movable plate 400 temporarily. The first slope 222 contacts with the release projection 320 to bend the barbed arm 220 toward the release direction when the connectors 100, 200 are to be connected. The second slope 223 is disposed on a distal surface of the pawl 221. The second slope 223 contacts with the release projection 320 to bend the barbed arm 220 toward the release direction when the connectors 100, 200 are to be disconnected. Each of the release projection 320 includes a first contact wall 321 and a second contact wall 322. The first contact wall 321 is a perpendicular wall disposed on a front end of the release projection 320 and contact with the first slope 222 of the barbed arm 220. The second contact wall 322 is an inclined wall disposed on a rear end of the release projection 320 and contact with the second slope 223 of the barbed arm 220.

Figure 21:
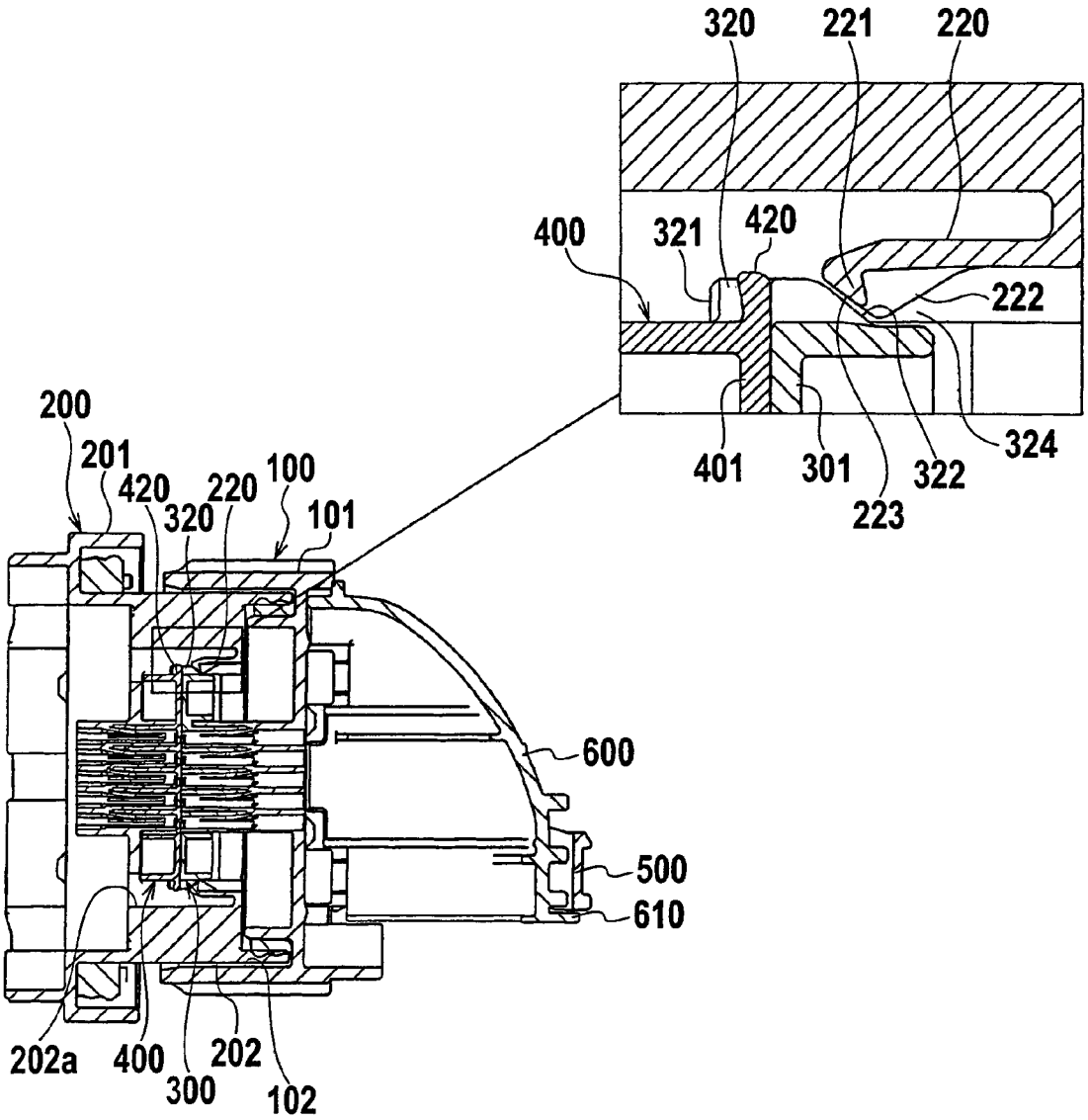
FIG. 21 is a cross-sectional view showing the female and male connectors connected completely (a portion is shown in close-up view).

Each pair of the pawl 221 and the hooking tab 420 offsets from each pair of the release projection 320 and the first slope 222 respectively in a perpendicular plane to a connecting direction of the connectors 100, 200. A space 324 is secured behind the release projection 320 for the barbed arm 220, which has restored its bending at a complete connection after the temporary connection, respectively (FIG. 21).

A lever attaching plane 111, which is formed one step lower than surrounding plane, is provided on a pair of right and left side planes 110 of the female connector housing 101, respectively. A respective side plate 510 of the lever 500 is coupled on each of the lever attaching face 111.

The lever 500 is used for connecting the connector and has an arch-shape. The lever 500 has a pair of side plates 510, each of which has an approximately circular-shape, and a knob 530 bridging the pair of side plates 510. An axial hole (coupling portion) 512, a slit 513, and a cam groove 514 are formed on each of the side plate 510. The respective cam groove 514 is formed on an inner face of the respective side plate 510. A respective entry gate 514*a* of the respective cam groove 514 is opening at a circumferential edge of the respective side plate 510.

The respective slit 513 extends in an arc shape around the axial hole 512 (a rotation center of the lever 500). The respective slit 513 has a tab 513*a* on its inner edge. The respective slit 513 extends in an overall rotating angle range of the lever 500 (including an attaching angle of the lever 500) around the respective axial hole 512 (center of the angle). The tab 513*a* extends in an ordinary rotating angle range of the lever 500. The ordinary rotating angle range (ordinary rotating range) will be described below.

The respective cam groove 514 extends in a prescribed angle range around the respective axial hole 512 (center of the angle). A distance from the axial hole 512 to the cam groove 514 decreases gradually from the entry gate 514*a* towards an opposite end, respectively.

A pin (coupling portion) 112, to which the axial hole 512 of the lever 500 is to be rotatably coupled, is provided on each of the lever attaching planes 111 on both sides of the female connector housing 101. The lever 500 is rotatably attached to the female connector housing 101 by coupling the pins 112 with the axial holes 512. The lever 500 is rotatable in a prescribed angle range, which is defined by a length of the slit 513, around the pin 112 (center of the angle). A respective guiding slit 114 is provided on a front side of the respective pin 112. Each of the guiding slits 114 extends straight from the entry gate 114*a* at a front end to a vicinity of the pin 112.

In addition, a hook 113 is provided around the pin 112 on each of the lever attaching plane 111. Each hook 113 is slidably coupled with the slit 513. A tab 113*a*, which hooks the tab 513*a* of the slit 513, is provided at a tip end of the hook 113. The uncoupling of the lever 500 from the pins 112 is prevented by engagement between the tab 113*a* and the tab 513*a*.

Furthermore, two tabs 515, 516 are provided on a circumferential edge of the respective side plate 510 of the lever 500 at some interval.

Figure 7:
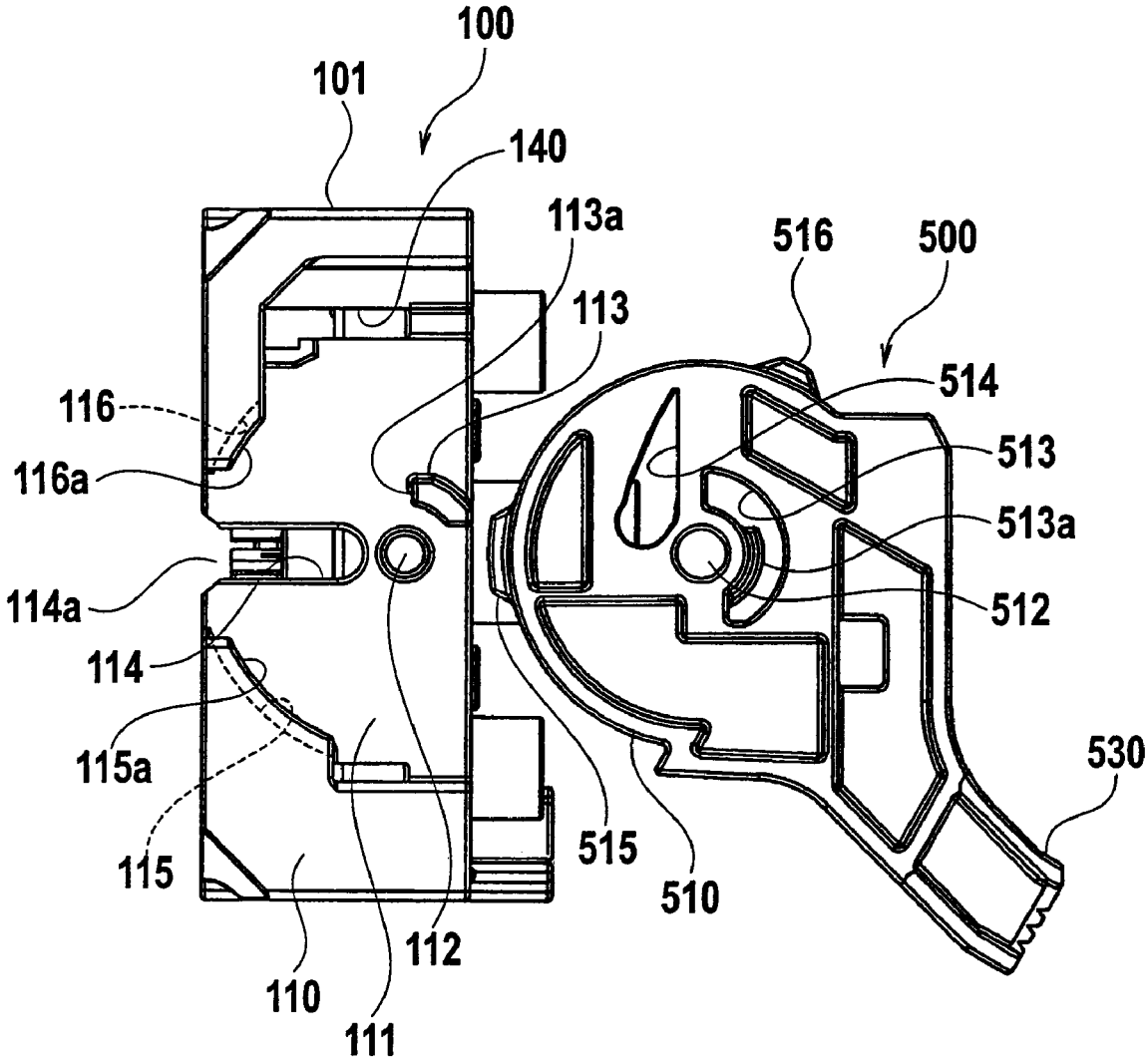
FIG. 7 is a side view showing a state before attaching a lever to the female connector.

Furthermore, curved walls 115, 116, which guide the circumferential edge of the respective side plate 510 are provided on a circumferential edge of the respective lever attaching face 111 of the female connector housing 101. The curved walls 115, 116 are provided on both sides of the guiding slit 114 respectively (FIG. 7). Flanges 115*a*, 116*a* extends from edges of the curved walls 115, 116 respectively in parallel to the respective lever attaching face 111. The uncoupling of the lever 500 from the female connector housing 101 is prevented by engagement between the flanges 115*a*, 116*a* and the tabs 515, 516. In other words, arched grooves are formed in ranges of the flanges 115*a*, 116*a* in order to hold the tabs 515, 516 slidably.

Figure 6:
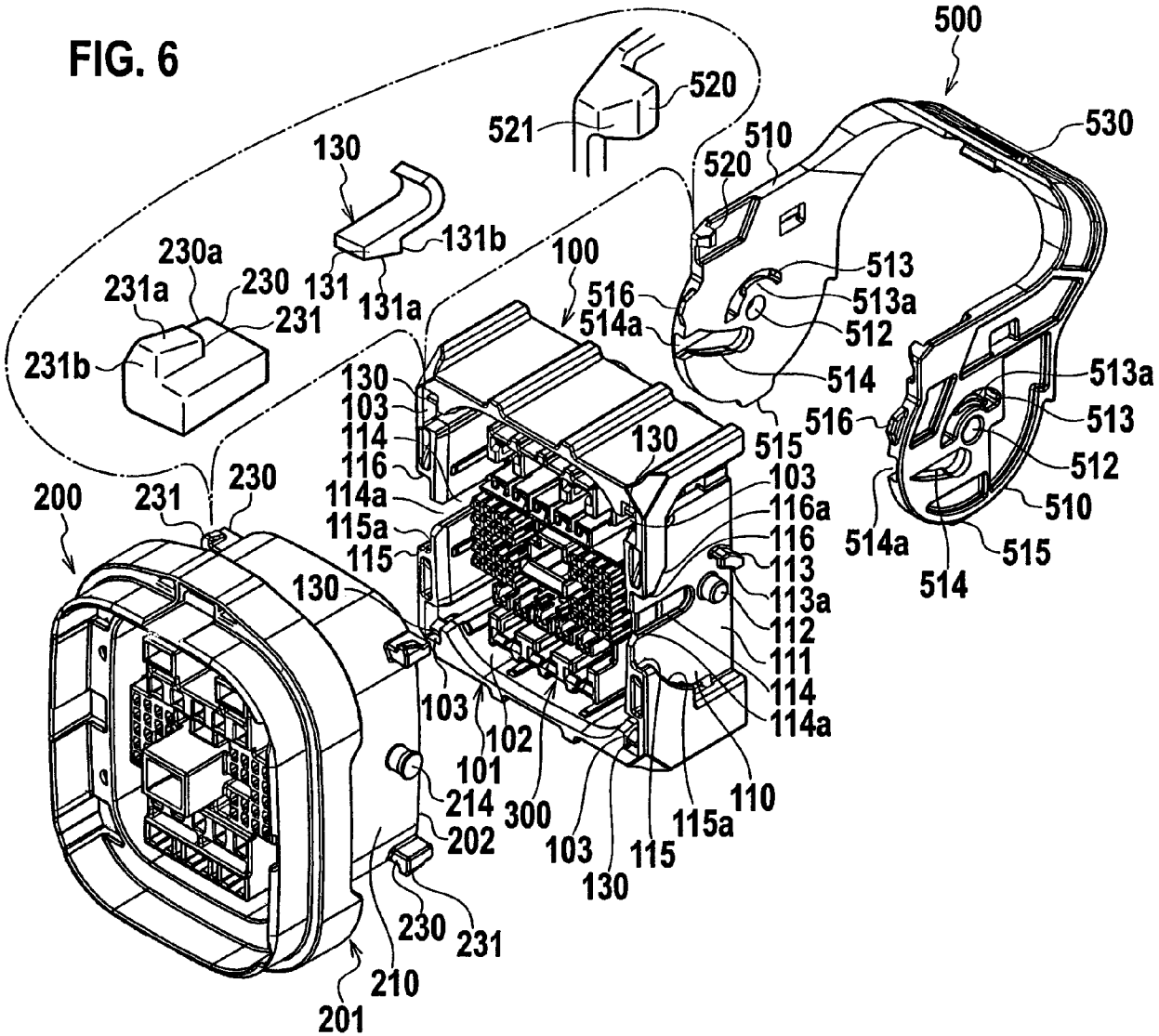
FIG. 6 is an exploded perspective view showing main elements of the embodiment (some portions are shown in close-up view)

As shown in FIG. 6, a pair of cam pins 214, which is guided by the cam grooves 514 of the lever 500, is provided on a side face of the hood 202 of the male connector housing 201. The pair of cam pins 214 is guided by the cam grooves 514 while sliding through the guiding slit 114 of the female connector housing 101.

In the present embodiment of the lever type connector, the attaching position of the lever 500 onto the female connector housing 101 is determined in a special position in relation to the ordinary rotating range of the lever 500. This point will be described hereinafter with an assembling procedure.

Figure 8:
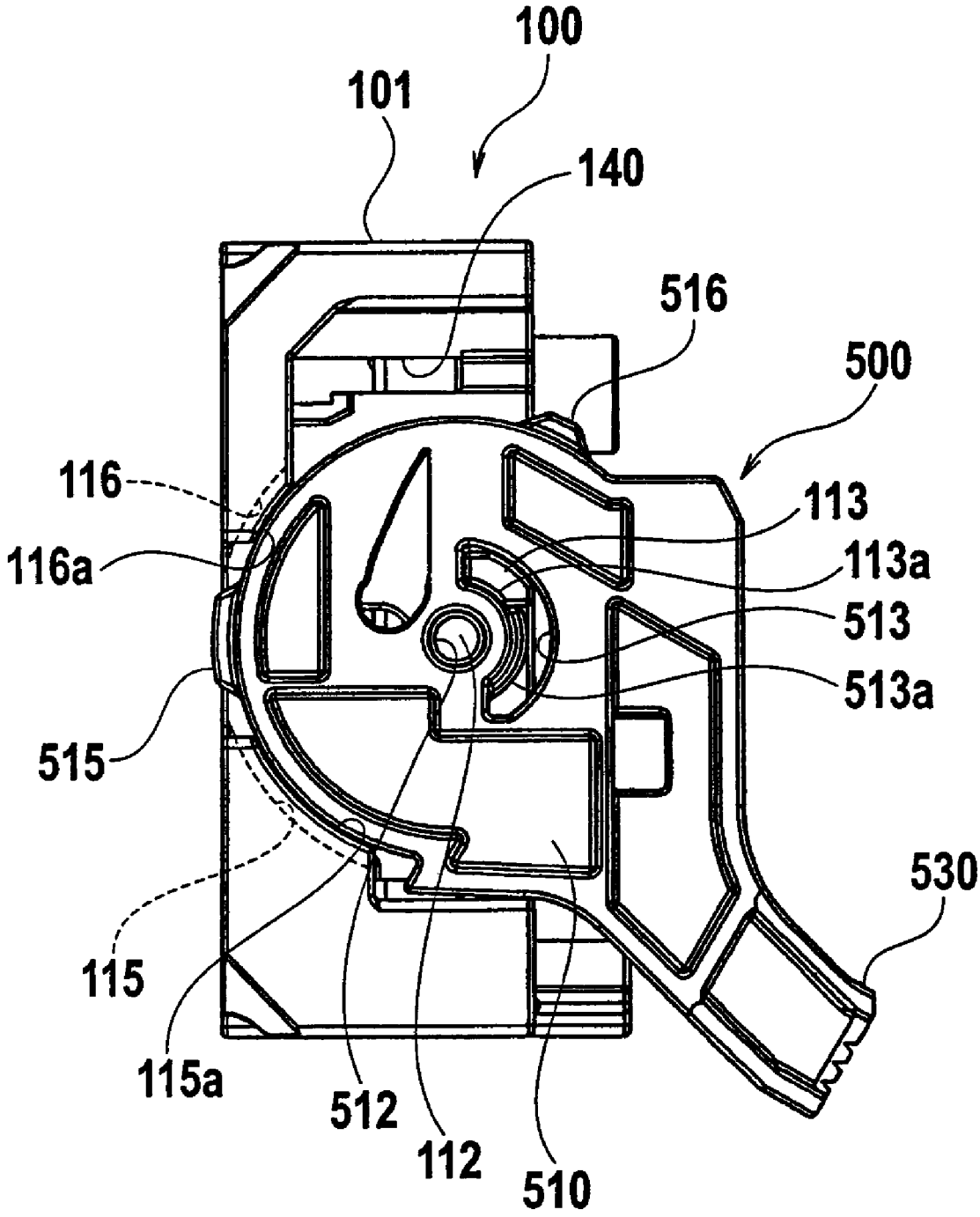
FIG. 8 is a side view showing a state after attaching the lever to the female connector.

FIG. 7 and FIG. 8 show a positional relationship between the female connector housing 101 and the lever 500 at attaching the lever 500 onto the female connector housing 101. The positions of the tabs 515, 516 of the lever 500 is unmatched with the positions of the flanges 115*a*, 116*a* of the female connector housing 101 respectively when the lever 500 is set at the attaching position. In addition, the position of the hook 113 and the position of the slit 513 are coincident, but the hook 113 and the tab 513*a* of the slit 513 are unmatched. In other words, holding mechanism (the tabs 113*a*, 513*a*, 515, 516 and the flanges 115*a*, 116*a*) is in an unholding state when the lever 500 is set at the attaching position.

In this state, the axial holes 512 of the lever 500 are coupled with the pins 112 of the female connector housing 101 respectively. When the lever 500 is attached onto the female connector housing 101, the lever 500 is bent in order to widen the distance between the pair of the side plates 510. As the axial holes 512 are coupled with the pins 112 respectively, both of the side plates 510 of the lever 500 are attached onto the lever attaching faces 111 respectively. Here, the hooks 113 are inserted into the slits 513 respectively, but the tabs 113*a* of the hook 113 and the tabs 513*a* of the slit 513 are unmatched. FIG. 8 shows a state immediately after the attaching of the lever 500.

Figure 9:
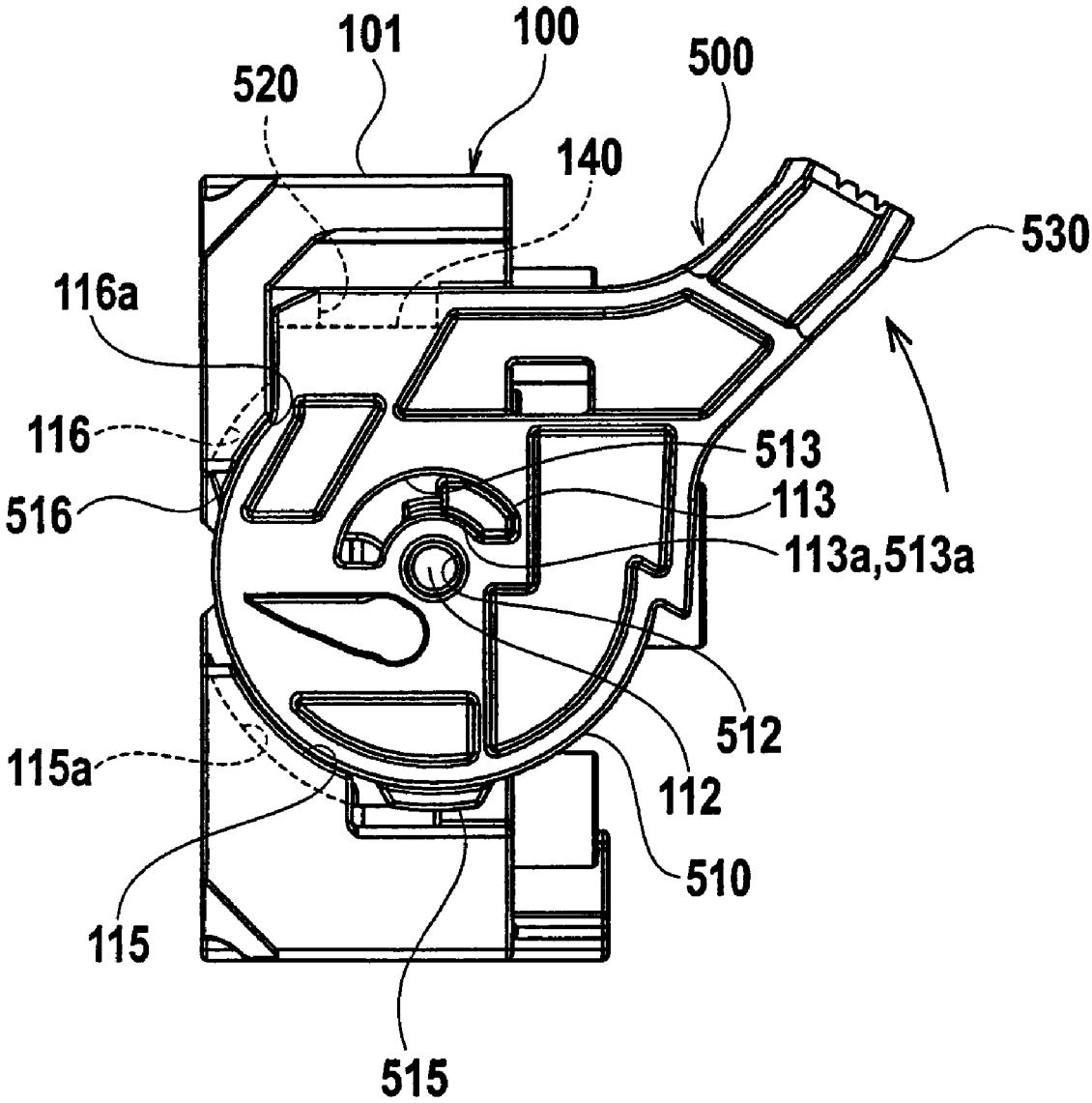
FIG. 9 is a side view showing a state in which the lever is rotated to a start position.

And then, the lever 500 is rotated in a direction of an arrow in FIG. 9 until the hooks 113 hits opposite ends of the slits 513 respectively. The tabs 113*a* of the hooks 113 and the tabs 513*a* of the slit 513 are overlapped respectively, and the lever 500 is held by the hooks 513. In addition, the tabs 515, 516 on the circumferential edges of the side plates 510 of the lever 500 are held by the flanges 115*a*, 116*a* respectively.

A position at which the hooks 113 hit the end of the slits 513 is a start position of the rotation of the lever 500. The entry gates 514*a* of the cam grooves 514 and the entry gates 114*a* of the guiding slits 114 are matched when the lever 500 is positioned at the start position, and it becomes possible to insert the cam pins 214 of the male connector housing 201 into them.

Guiding structure is provided on the connector housings 101, 201 for guiding the respective cam pin 214 to the entry gate 514*a* of the respective cam groove 514 at the initial stage of connecting the connectors 100, 200. The guiding structure includes temporary connecting structure for holding a temporarily connecting state of the connectors 100, 200 at the connecting initial stage.

As shown in FIG. 6, the temporary connecting structure is provided on the connector housings 101, 201 for holding the temporarily connecting state. The temporary connecting structure on the female connector housing 101 is configured with barbed tabs (arms) 130. The temporary connecting structure on the male connector housing 201 is configured with projecting tabs 230 projected from an outer circumferential surface of the hood 202.

The barbed tabs 130 are disposed with in insertion holes 103 provided on four corners of an outer circumferential wall of the female connector housing 101, respectively. The respective barbed tab 130 is engaged with the respective projecting tab 230 when the respective projecting tab 230 is inserted into the respective insertion hole 103.

Each of the barbed tab 130 has a pawl 131 and each projecting tab 230 has a projection 231. An engaging plane 131*b* of the pawl 131 and an engaging plane 231*b* are engaged each other to produce engaging force of the temporary connecting. Engaging planes 131*b*, 231*b* are almost perpendicular to the connecting direction of the connectors 100, 200.

Each of the pawls 131 has a guiding slope 131*a* and each of the projection 231 also has a guiding slope 231*a*, as elements of the guiding structure. The guiding slopes 131*a*, 231*a* are frictioned each other as the initial connection of the connector housings 101, 201 proceeds, and align positions of the connector housings 101, 201. Therefore, the barbed tabs 130 and the projecting tabs 230 (the guiding slopes 131*a*, 231*a*) function as frictioning portions for guiding the cam pins 214 to the cam grooves 514 respectively. The guiding slopes 131*a*, 231*a* are disposed on forward positions to the engaging planes 131*b*, 231*b* in the connecting direction, respectively.

Furthermore, temporary holding structure, which holds the lever 500 temporarily at the start position of rotation, is provided between the lever 500 and the female connector housing 101. The temporary holding structure on the lever 500 is configured with holding projections 520, each of which is projected from an inner surfaces of the respective side plate 510 of the lever 500. The temporary holding structure on the female connector housing 101 is configured with holding holes 140, each of which is engaged with the respective holding projection 520 (FIG. 7). Each of the holding holes 140 communicates with the respective insertion hole 103, within which the barbed tab 130 is disposed. A part of the holding projection 520 is exposed within the insertion hole 103 when the holding projection 520 engages with the holding hole 140, respectively.

Since the temporary holding structure has above described structure, an engagement between the holding projections 520 and the holding holes 140 is released when the temporary connecting structure (the barbed tabs 130 and the projecting tabs 230) is connected temporarily. In detail, temporary holding of the lever 500 is released when the projecting tabs 230 push the holding projections 520 toward the outside through the holding holes 140, respectively.

Each of the holding projections 520 has a guiding slope 521 on its inner front portion and each of the projecting tabs 230 has a guiding slope 230*a* on its outer side portion. The guiding slope 230*a* of the projecting tab 230 contacts with the guiding slope 521 of the holding projection 520 respectively at the temporary connection of the connector 100, 200. At this time, elastic restoring forces of the side plates 510, which have the holding projections 520, act on the male connector housing 201 via the projecting tabs 230. The elastic restoring forces are almost equal and act from both side of the male connector housing 201. The two elastic restoring forces act in opposite directions each other. Therefore, the elastic restoring forces can adjust a lateral relative position between the female connector housings 101 and the male connector housing 201.

Figure 10:
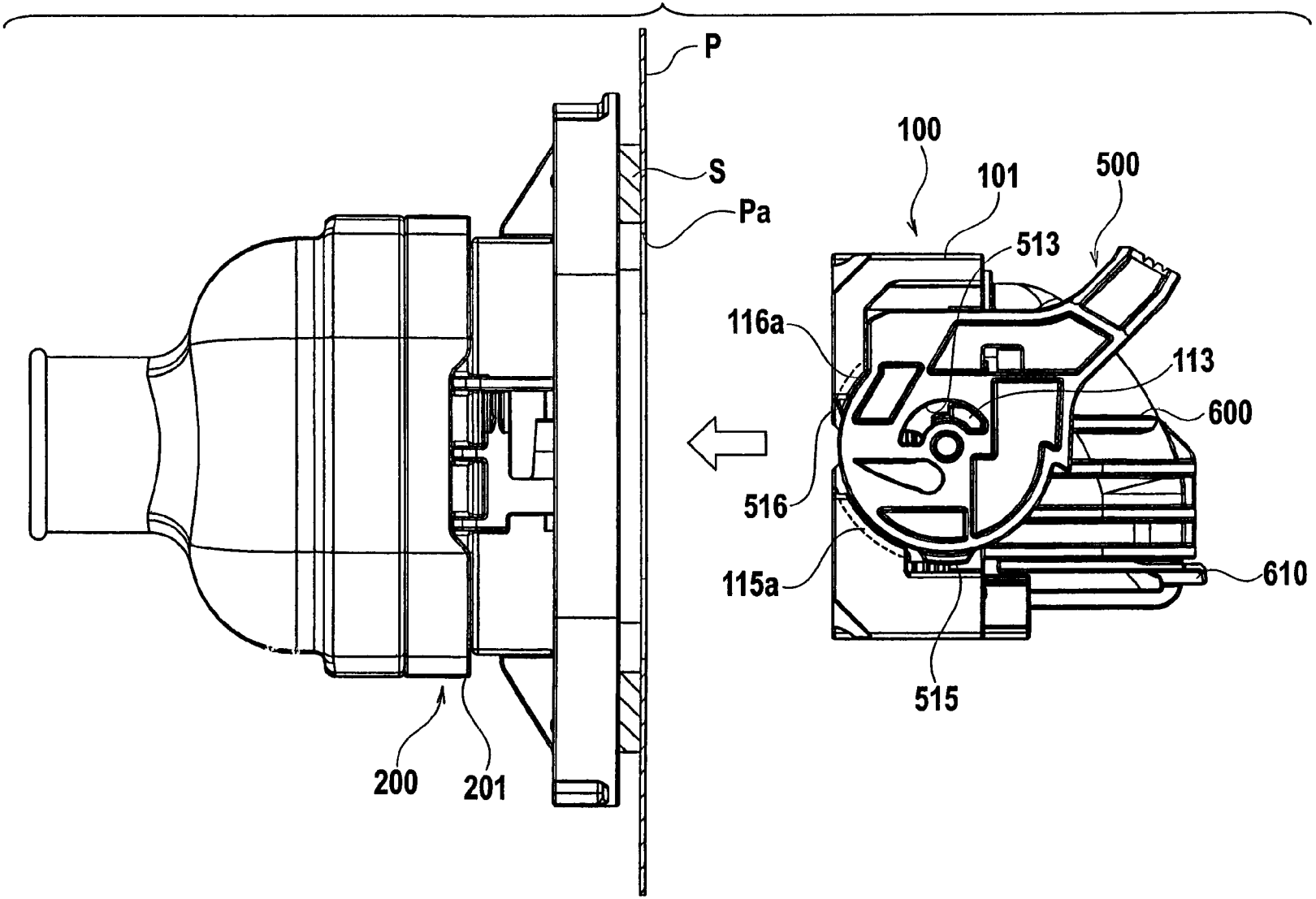
FIG. 10 is a side view showing a state in which the female and male connectors are set face to face with a car body panel therebetween.

Next, connecting process will be described. When the pair of connectors 100 and 200 are to be connected, as shown in FIG. 10, the female connector 100 with the lever 500 set at the start position (shown in FIG. 9) is positioned against the male connector 200 attached on a car body panel P. In FIG. 10, Pa is an aperture of the car body panel P and S is a sealing member.

Figure 11:
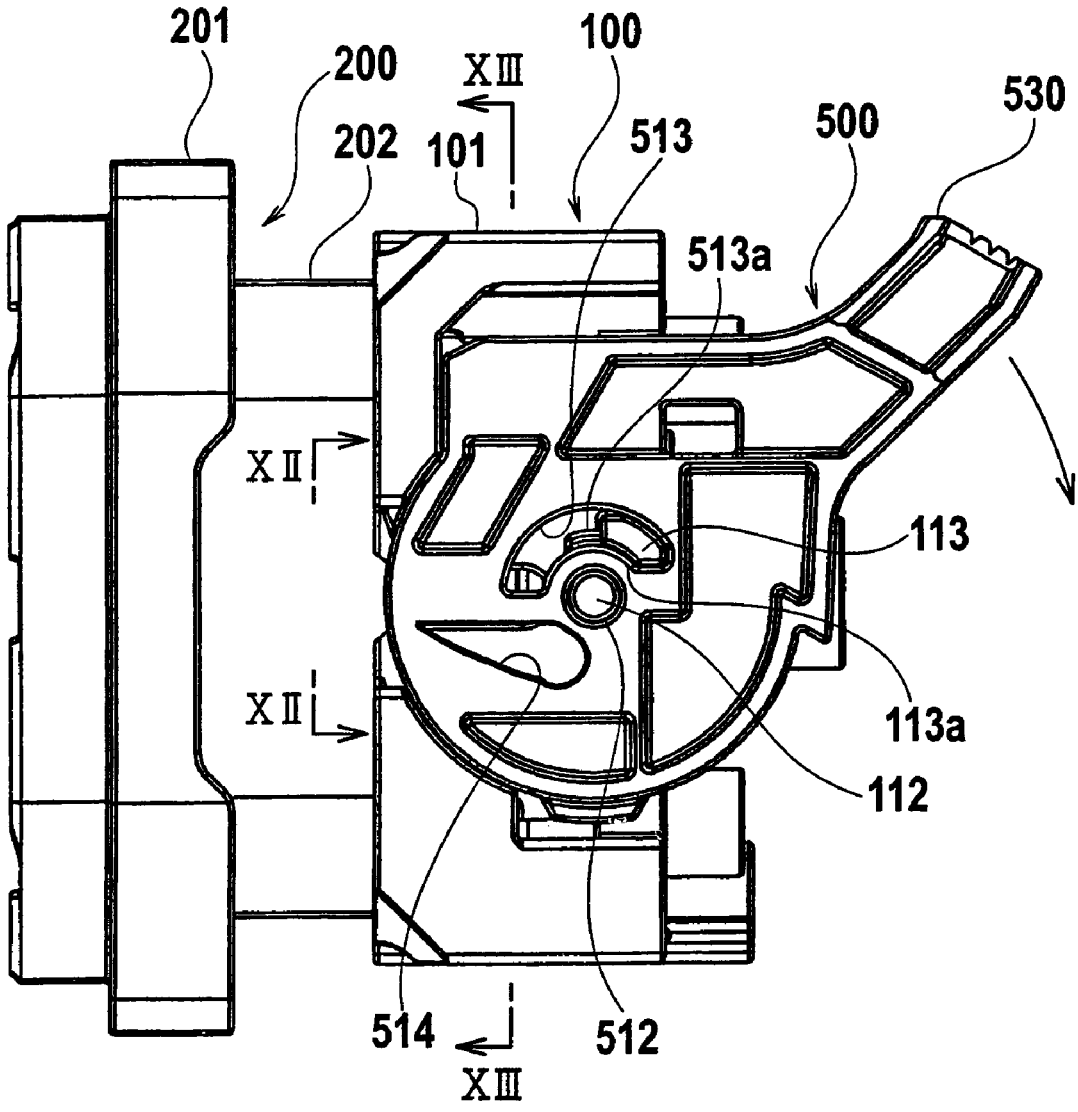
FIG. 11 is a side view showing an initial stage of connecting the female and male connectors.
Figure 12:
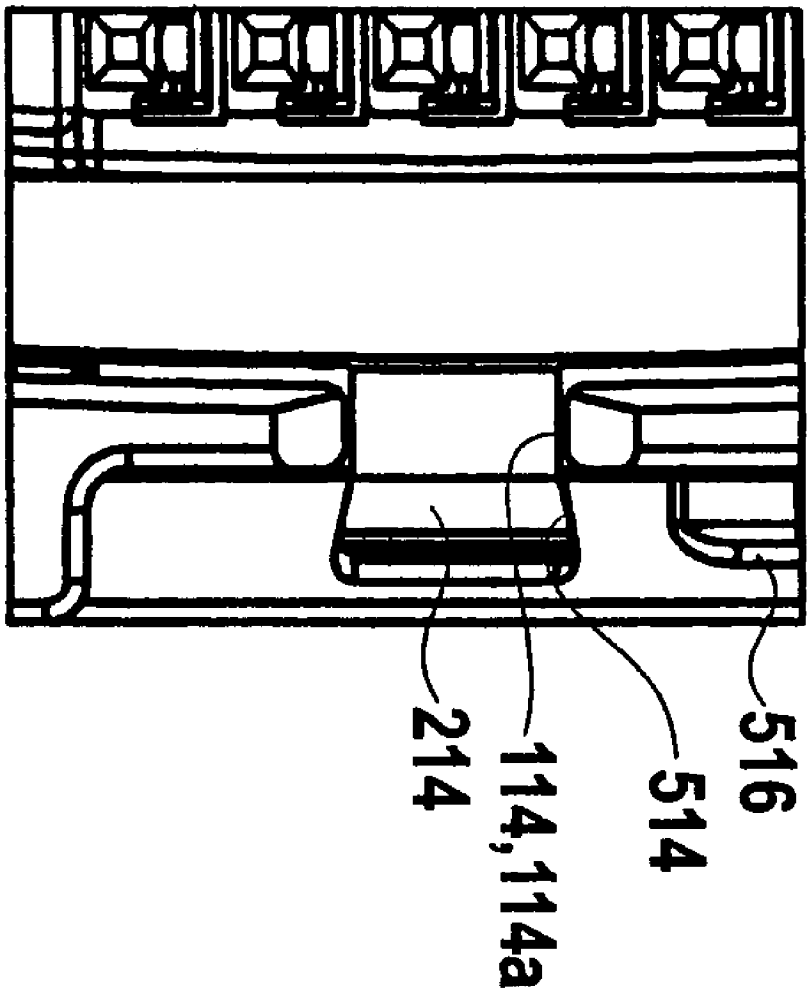
FIG. 12 is a view from a direction of arrows XII-XII in FIG. 11.
Figure 13:
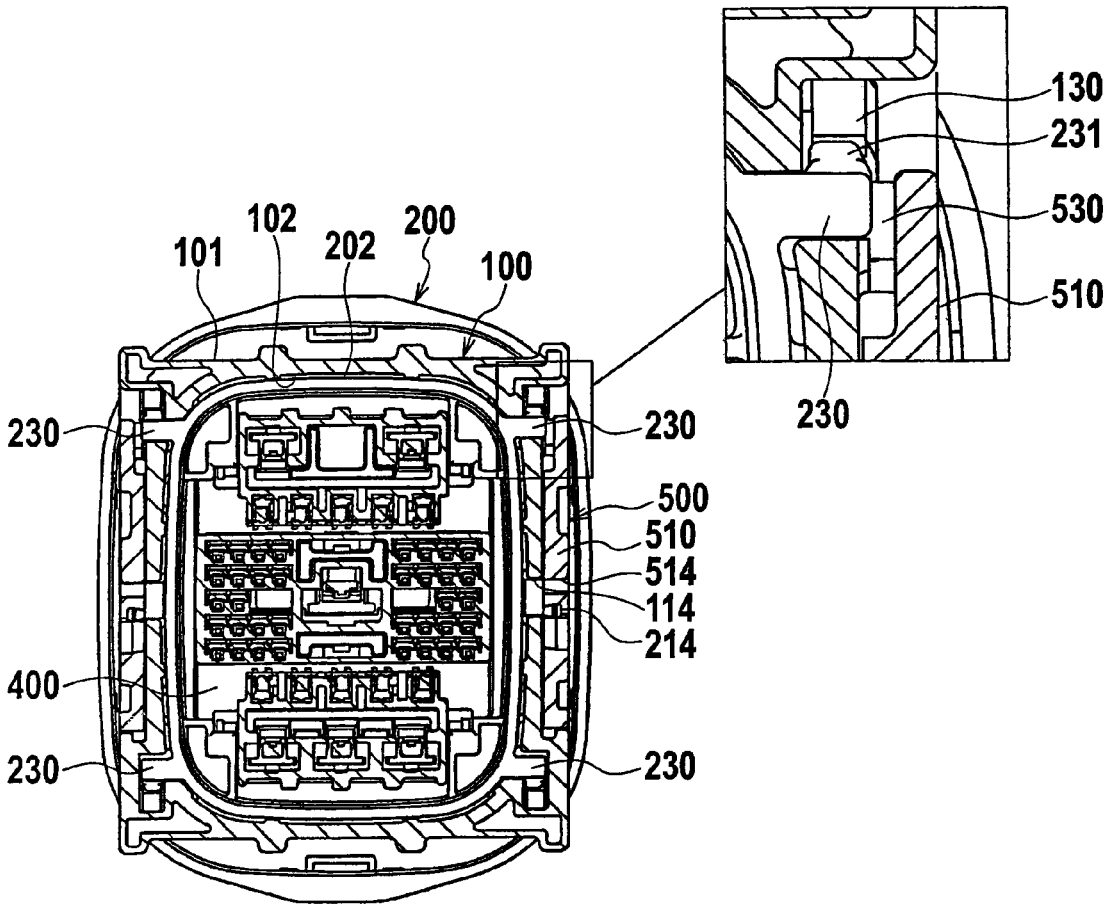
FIG. 13 is a cross-sectional view taken along line XIII-XIII in FIG. 11 (a portion is shown in close-up view)

In this state, the female connector 100 and the male connector 200 are connected temporarily (initial connecting). The cam pins 214 of the male connector housing 201 are entered from the entry gates 114*a*, 514*a* into the guiding slits 114 of the female connector housing 101 and the cam grooves 514 of the lever 500, respectively. FIG. 11 and FIG. 13 show a state at this point, and FIG. 12 shows a state in which the cam pins 214 have entered into the guiding slits 114 and the cam grooves 514.

A perpendicular relative position between the female connector housing 101 and the male connector housing 201 can be aligned properly by guiding effect with the friction between the guiding slopes 13 la of the barbed tabs 130 and the guiding slopes 23 la of the projecting tabs 230, as the temporary connecting proceeds.

In addition, temporary holding of the lever 500 is released because the projecting tabs 230 pushes the holding projections 520 toward the outside respectively, as the temporary connecting proceeds. Furthermore, at the same time, a lateral position between the female connector housing 101 and the male connector housing 201 can be aligned properly by elastic restoring forces of the side plates 510.

Since the perpendicular and lateral relative positions between the female connector housing 101 and the male connector housing 201 can be aligned properly, the cam pins 214 and the entry gates 514*a* of the cam grooves 514 become coincide to enter the cam pins 214 smoothly into the entry gates 514*a*, respectively.

Furthermore, a relative position in the connecting direction between the female connector housing 101 and the male connector housing 201 can be aligned by the temporary connecting of the temporary connecting structure (the barbed tabs 130 and the projecting tabs 230). And the position can be temporarily held. Therefore, the cam pins 214 can be entered within the cam grooves 514 smoothly by rotating the lever 500 which has been released under the temporary connecting.

In this case, since the temporary holding of the lever 500 can be released when the temporary connecting structure (the barbed tabs 130 and the projecting tabs 230) becomes a temporarily connecting state, the lever 500 can be rotated as a next operation just after the temporarily connecting state. In other words, the lever 500 can be held until the connectors 100, 200 are temporarily connected, and can be rotated only after the connectors 100, 200 are temporarily connected. As a result, operating status (held or rotatable) of the lever 500 can be changed without the need of a special operation, and then connecting workability can be improved effectively.

Furthermore, since the guiding slopes 131*a*, 231*a*, 230*a*, 521 are provided as described above, the cam pins 214 can be guided properly to the entry gates 114*a*, 514*a*, at the temporary (initial) connection of the connectors 100, 200 even when connecting potions of the both connectors have much looseness.

Figure 14:
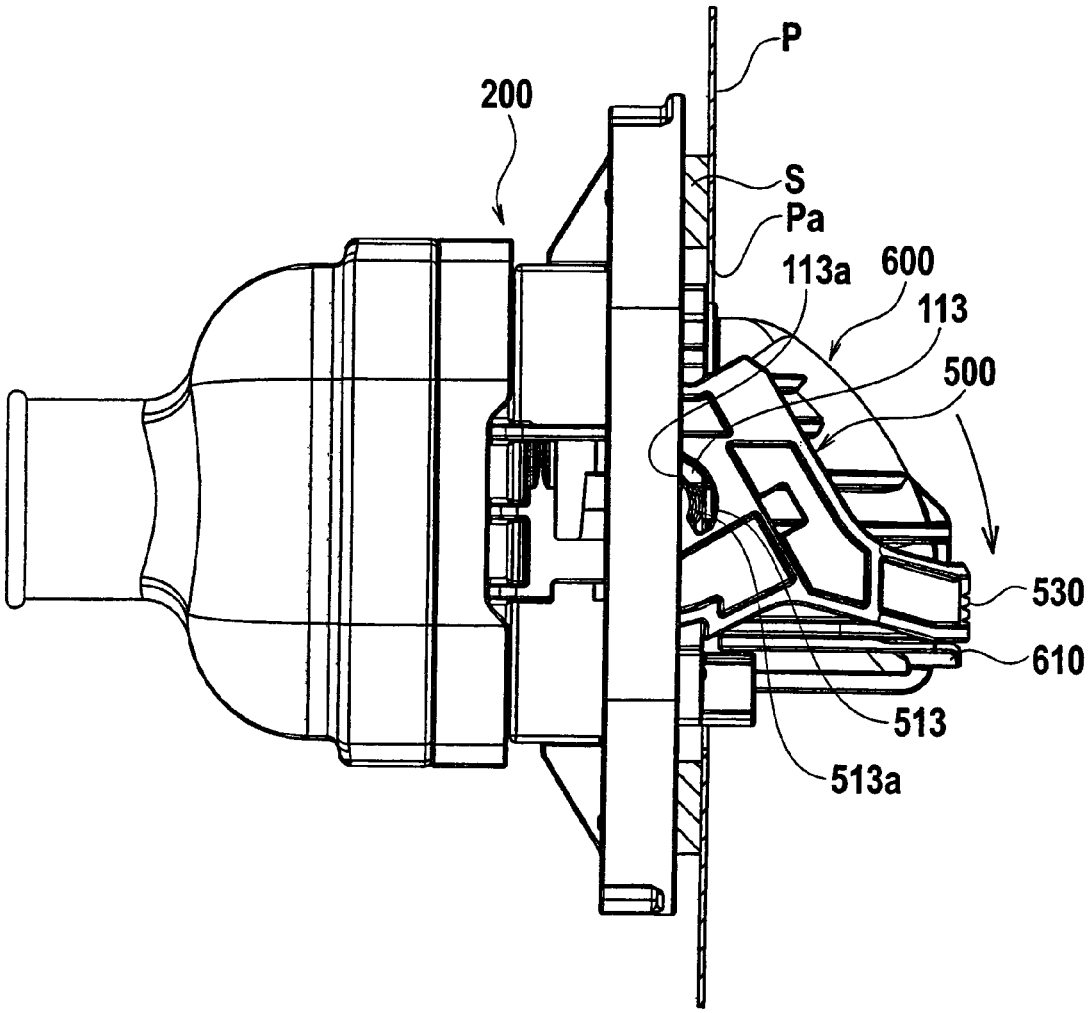
FIG. 14 is a side view showing a state in which the female and male connectors are connected by rotating the lever to an end position.
Figure 15:
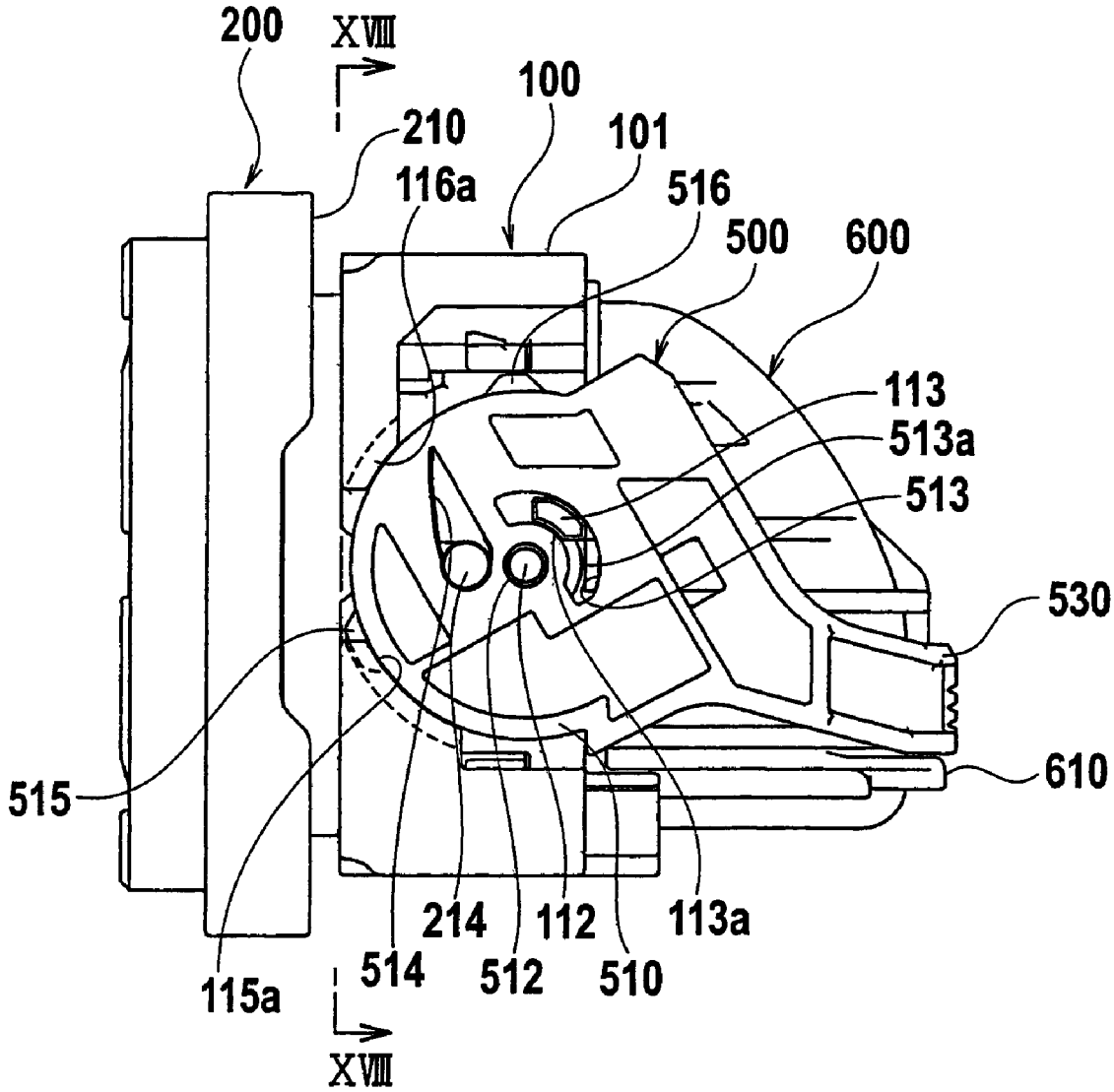
FIG. 15 is a side view showing only the female and male connectors of FIG. 14.
Figure 16:
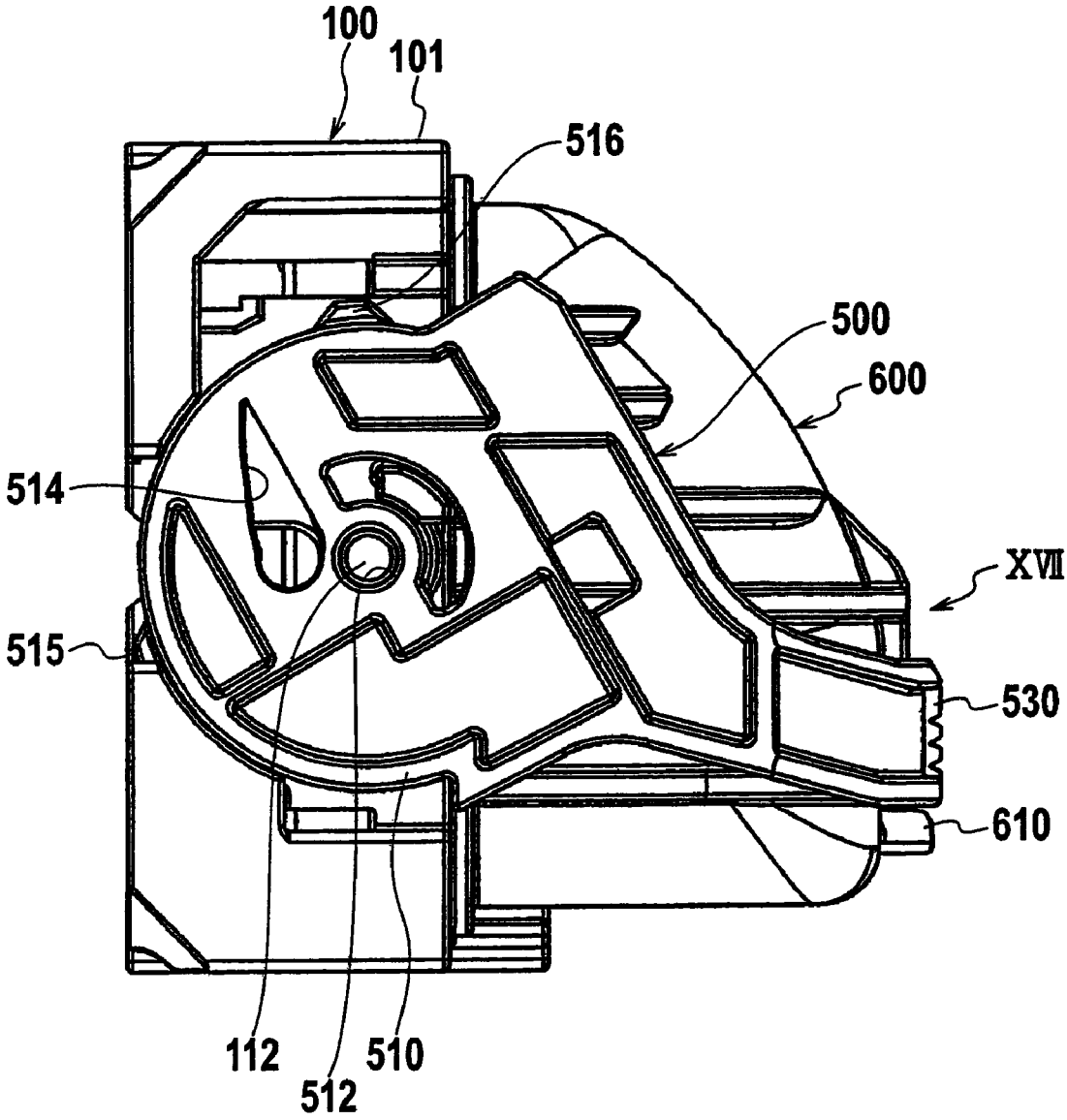
FIG. 16 is a side view showing a relationship among the female and male connectors and the lever shown in FIG. 15
Figure 17:
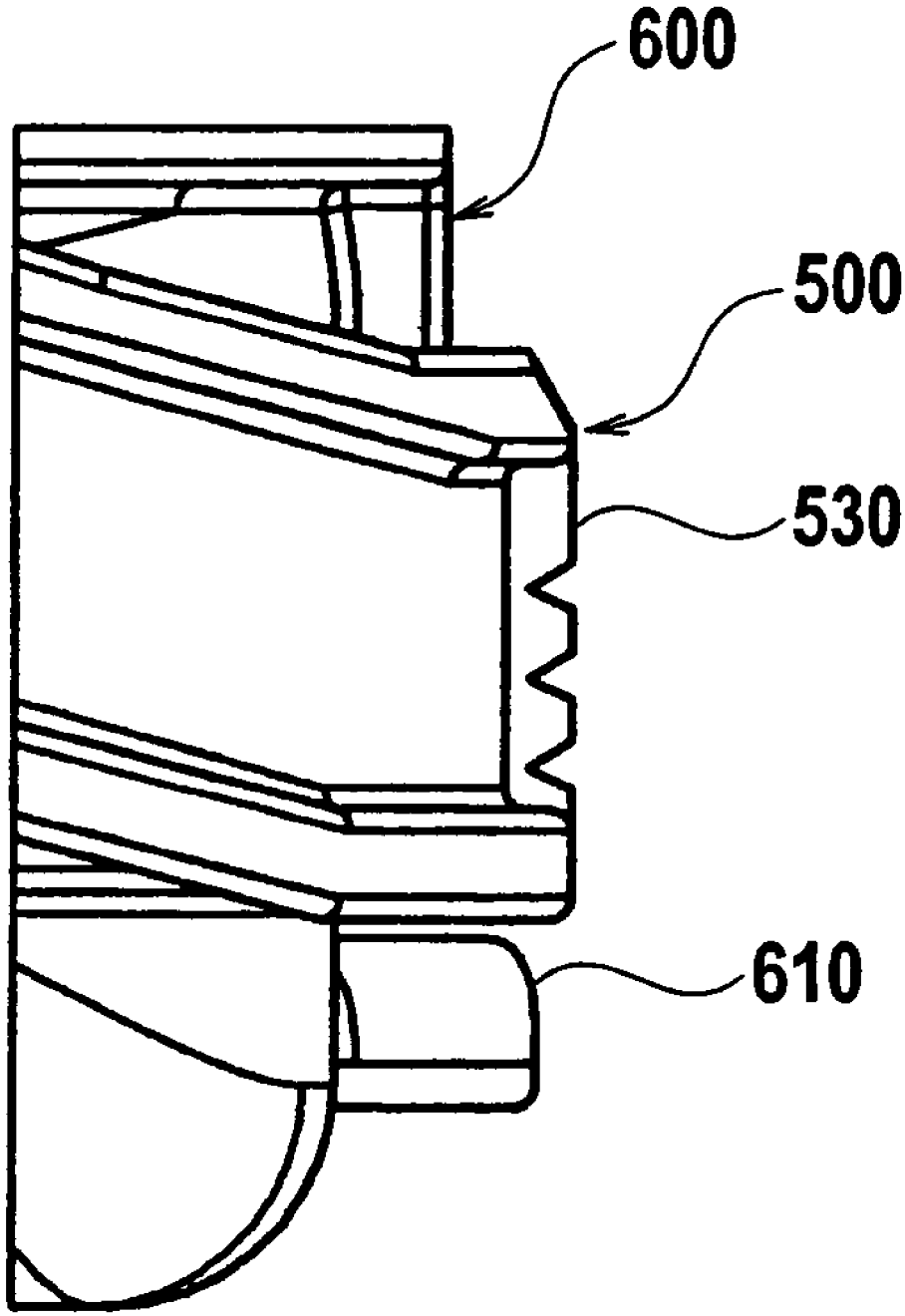
FIG. 17 is an enlarged view of a portion XVII shown in FIG. 16.
Figure 18:
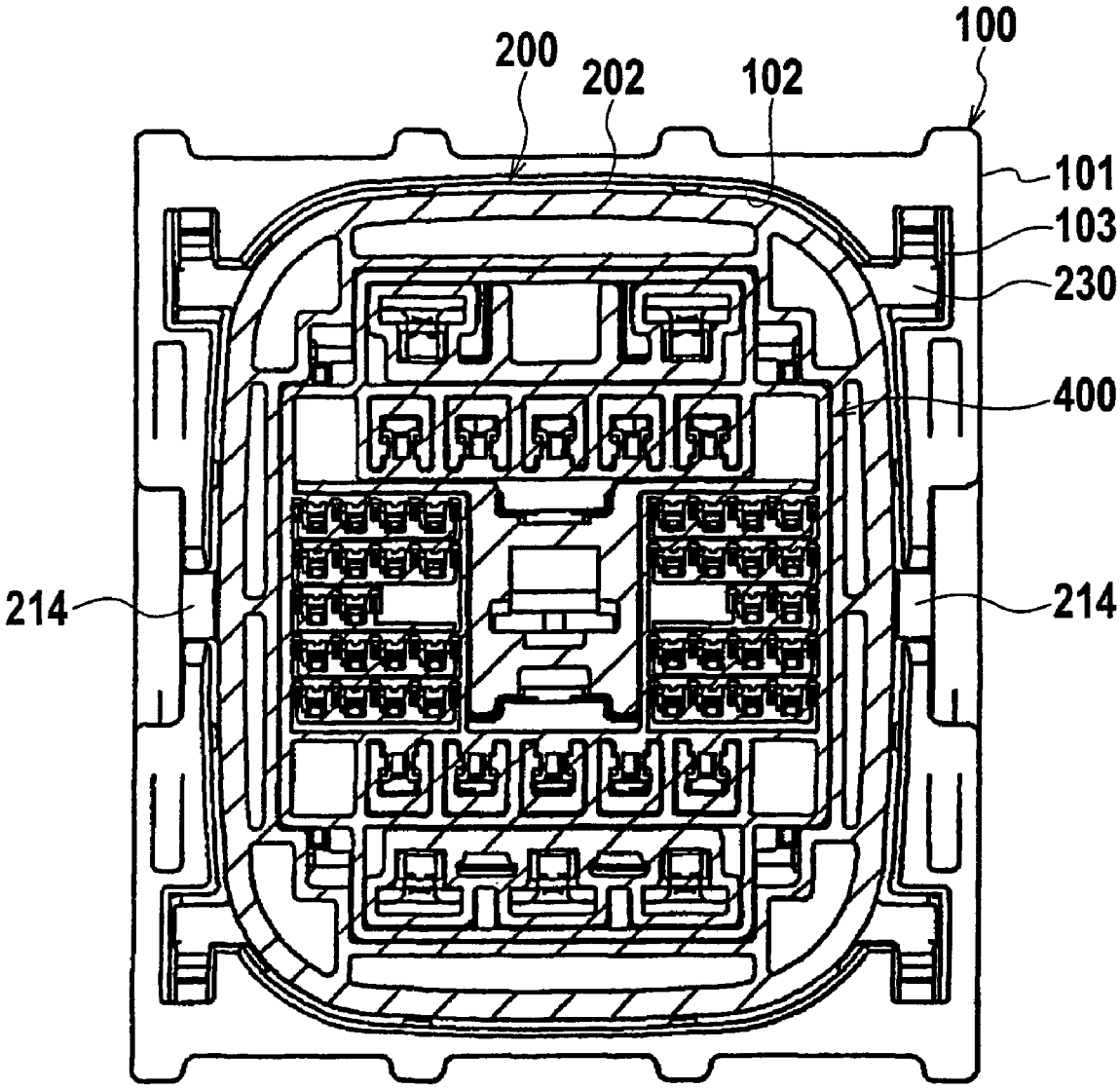
FIG. 18 is a cross-sectional view taken along line XVIII-XVIII in FIG. 15.
Figure 19:
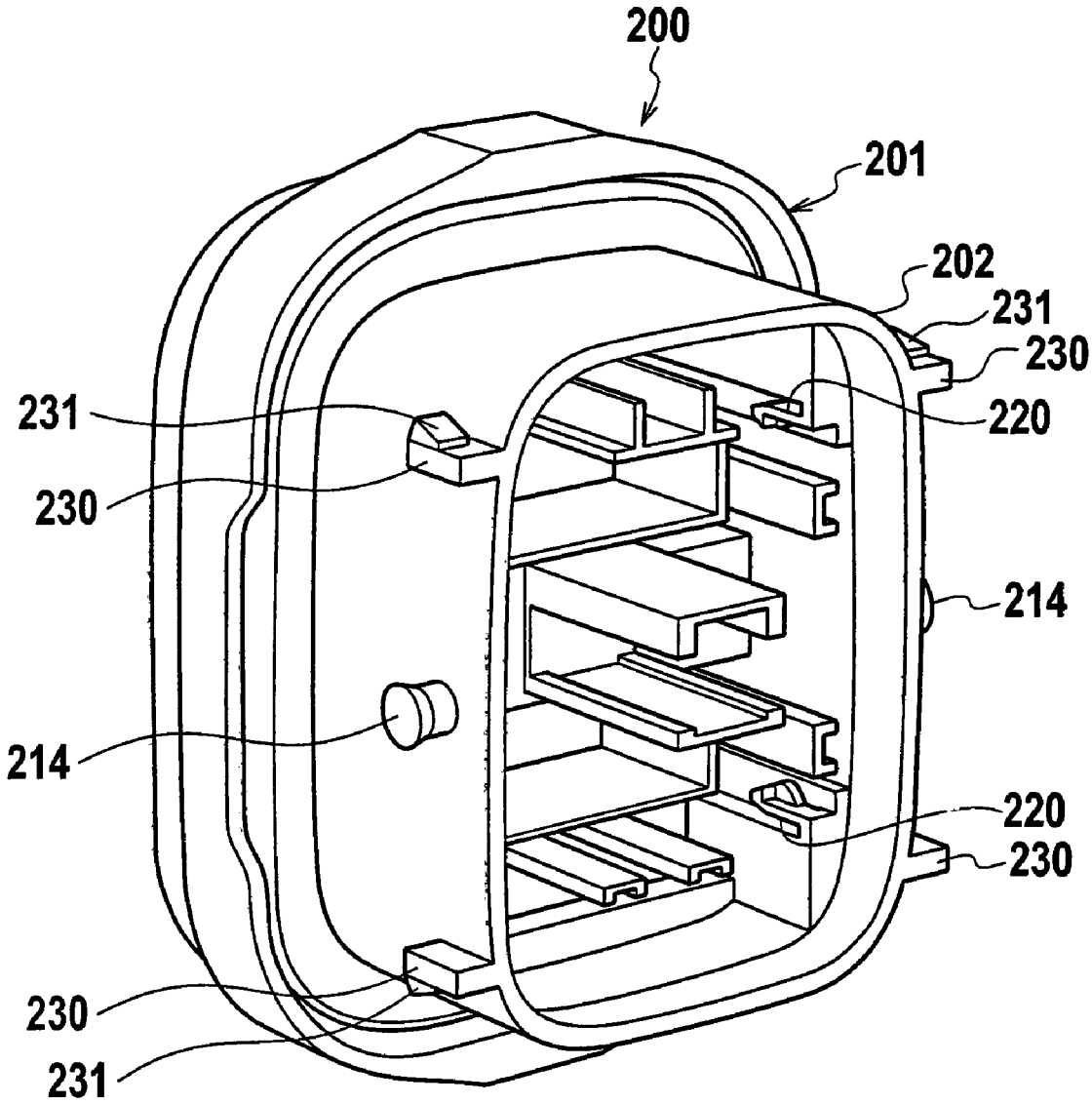
FIG. 19 is a perspective view showing the male connector housing viewed from its front side.
Figure 20:
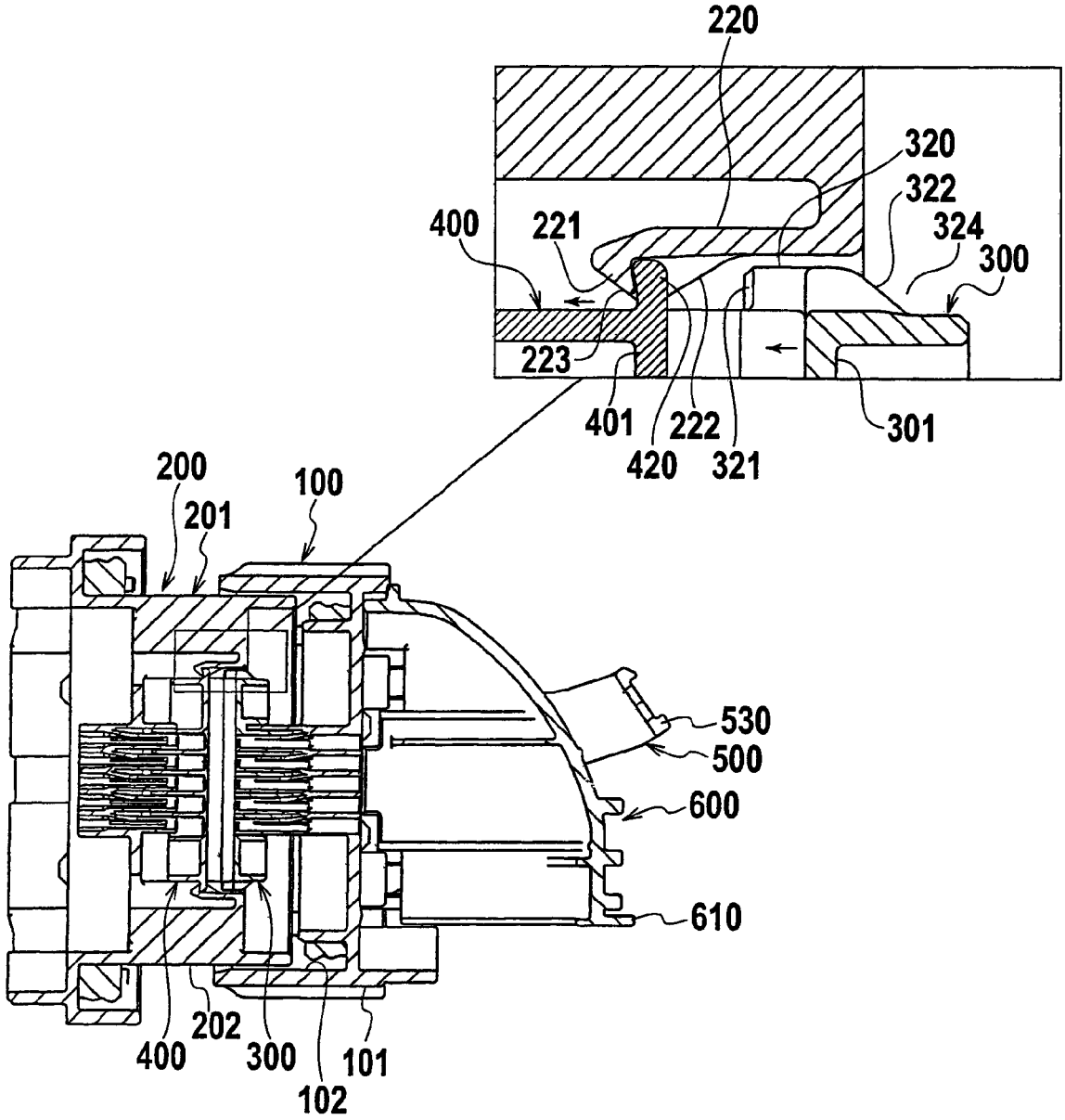
FIG. 20 is a cross-sectional view showing an initial stage of connecting the female and male connectors (a portion is shown in close-up view)

From the state of FIG. 11, the lever 500 is rotated in a direction of an arrow in FIG. 11 using the knob 530, and moved to the position shown in FIG. 14 to FIG. 16. And then, the connector housings 101, 201 are completely connected by the cam structure between the cam grooves 514 and the cam pins 214. A position of the lever 500 at this point is an end position of the rotation. Note that, in FIG. 14 to FIG. 16, the cover 600 is attached on a backside of the female connector 100. The cover 600 is attached after the installation of metallic terminals and electric wires into the female connector 100 is finished. The electric wires are collectively lead out to one direction by the cover 600 (downwards in FIG. 14 to FIG. 16).

When the rotation range from the start position to the end position is defined as the ordinary rotation rage for connecting the connector, the attaching position of the lever 500 described above is set outside of the ordinary rotation range.

Consequently, the lever 500 will not be rotated to the attaching position by error during an ordinary operation. The lever 500 can be detached at the attaching position. However, the lever 500 will not be rotated to the attaching position during the ordinary operation, so that the lever 500 will not uncouple even if an external force (a lateral load onto the lever 500 or the like) is applied during the ordinary operation of the lever 500 (the connector connecting operation). Note that, it is also possible to prevent the uncoupling of the lever 500 by setting a coupling structure between the lever 500 and the female connector housing 101 severely and coupling the lever 500 with the female connector housing 101 forcefully. However, the attaching operation of the lever 500 onto the female connector housing 101 becomes cumbersome. In the present embodiment, the attaching position of the lever 500 is set specially so that the attaching operation of the lever 500 does not become cumbersome and the attaching operation can be effectively improved.

Furthermore, in the present embodiment, the attaching position of the lever 500 is set in a vicinity of the end position of the lever 500 outside of the ordinary operation range. Therefore, a waiting state for accepting the cam pins 214 (that is, connecting the connector) can be made ready only by rotating the lever 500 from the attaching position to the start position thorough the end position, as described above. In other words, the attaching position (that is, a uncoupling position) of the lever 500 is set at a position far from the start position, so that the lever 500 set at the start position will not be returned back to the attaching position by error.

Note that, the lever 500 has already completed a required function (connecting function) when the lever 500 is positioned at the end position as shown in FIG. 14 to FIG. 16. For this reason, there is no practical adverse affect even if the lever 500 is rotated back to the attaching position by error from the end position.

As shown in FIG. 15 and FIG. 16, the hooks 113 have not hit the ends of the slits 513 (ends near the attaching position) yet when the lever 500 is positioned at the end position. Therefore, if the rotation of the lever 500 were not regulated, it would be possible to rotate the lever 500 further. However, in the present embodiment, as shown in FIG. 14 to FIG. 17, a stopper 610, which contacts with the knob 530 when the lever 500 is positioned at the end position, is provided on the cover 600 in order to prevent the further rotation of the lever 500 beyond the end position. As a result, the lever 500 will not be rotated back to the attaching position by error, and the uncoupling of the lever 500 under a connected state of the connector cannot occur.

Furthermore, within the ordinary rotating range of the lever 500 from the start position to the end position, the tabs 113*a* of the hooks 113 hold the tabs 513*a* of the slits 513. In addition, the flanges 115*a*, 116*a* hold the tabs 515, 516 alternatively or simultaneously according to the rotation position of the lever 500. Therefore, the uncoupling of the lever 500 can be prevented more surely during the ordinary operation of connecting the connector.

Furthermore, the stopper 610 is provided on the cover 600. Since the cover 600 is attached to the female connector housing 101 after attaching the lever 500 on to the female connector housing 101, the attaching process of the lever 500 onto the female connector housing 101 can be done easily before attaching the cover 600.

On the contrary, the lever 500 is rotated in an opposite direction when the connectors 100 and 200 are to be disconnected. Then, the connector housings 101 and 201 are disconnected by utilizing the principle of leverage between the cam grooves 514 and the cam pins 214. In this case, since uncoupling of the lever 500 never occurs by the stopper 600, the lever 500 is surely held at the end position by the stopper 610. Therefore, the connectors 100 and 200 can be uncoupled by using the lever 500 which has not uncoupled.

According to the present embodiment, processes and effects described hereinafter can be achieved.

Since the release projections 320 of the front holder 300 firstly contact the first slopes 222 of the barbed arms 220 respectively when the connectors 100, 200 are to be connected (shown in FIG. 20), the barbed arms 220 are bent toward the release directions (upward in FIG. 20) and then temporary engagements of the hooking tabs 420 of the movable plate 400 are released.

After the release of the engagements between the barbed arms 220 and the hooking tabs 420, the movable plate 400 can become slidable. As the connecting operation proceeds, the front holder 300 will contact the movable plate 400 and then push it backward.

The movable plate 400 is pushed to an end position under the complete connection of the connectors 100, 200, as shown in FIG. 21. In this state, since the spaces 324 are secured behind the release projections 320 of the front holder 300 respectively, the barbed arms 220, which have restored their bending at the complete connection after the temporary connection, are stowed in the spaces 324 respectively.

Therefore, continuous bending of the barbed arms 220 under the connecting state of the connectors 100, 200 is prevented. As a result, reduction of temporary connecting performance is prevented. In addition, since the barbed arms 220 are not bent under the temporary or complete connecting state, it is prevented that the external force would act on the barbed arms 220 even when the external force acts on the connectors 100, 200. As a result, durability against an external force is improved.

Furthermore, the release projections 320, which bend the barbed arms 220 toward the release directions respectively as the connection of the connectors 100, 200 proceeds, are provided not directly on the female connector housing 101 but on the front holder 300 attached onto the female connector housing 101. Since the respective space 324 would not become an undercut portion of injection molding, an access hole, which is often made by a telescoping shutoff of injection molding to mold an undercut portion, is not made on the female connector 100 for the spaces 324. Therefore, it could never happen that water infiltrates into the inside of the connectors 100, 200 through an access hole. As a result, deterioration of waterproofing and noise-and-vibration performances concerning the female connector 100 is prevented.

Furthermore, in the present embodiment, each pair of the pawl 221 and the hooking tab 420 offsets from each pair of the release projection 320 and the first slope 222 respectively in a perpendicular plane to a connecting direction of the connectors 100, 200. Therefore, compact design, such as short length in the connecting direction, can be provided.

Furthermore, the second slope 223, which is disposed on a distal end of the respective barbed arm 223, produces disconnecting force by contacting with the release projection 320 of the front holder 300 at the disconnection of the connectors 100, 200.

Therefore, the connectors 100, 200 can be disconnected smoothly.

What is claimed is:

1. A lever type connector, comprising:

first and second connector housings to be connected with each other;

a lever which is rotatably attached to the first connector housing and has cam grooves; and cam pins which are provided on the second connector housing and guided by the cam grooves respectively, wherein connecting or disconnecting of the first and second connector housings is assisted by rotating the lever in a state where the cam pins are inserted into the cam grooves respectively, guiding structure is provided between the first and second connector housings for guiding the cam pins to entry gates of the cam grooves respectively as connection of the first and second connector housings proceeds at an initial stage of the connection, the lever includes a pair of side panels, the pair of side panels includes the cam grooves respectively and rotatably coupled with a pair of sidewalls of the first connector housing respectively, the entry gates of the cam grooves open at circumferential edges of the pair of the side panels respectively, the cam pins are projected from a pair of sidewalls of the second connector housing respectively, the guiding structure includes a pair of frictioning portions which is to be frictioned each other as the connection proceeds at the initial stage to align a relative position in a first direction between the first and second connector housings in order to guide the cam pins to entry gates of the cam grooves respectively, the first direction being perpendicular to a connecting direction of the first and second connector housings, and the pair of frictioning portions includes guiding slopes facing toward the first direction respectively.

2. The lever type connector according to claim 1, further comprising:

temporary connecting structure for connecting the first and second connector housings temporarily at the initial stage is provided between the first and second connector housings, wherein the temporary connecting structure includes a pair of engaging planes which is to be engaged each other to connect the first and second connector housings temporarily, the pair of frictioning portions is disposed forward the pair of engaging planes in the connecting direction respectively, and the temporary connecting structure includes at least one arm which includes one frictioning portion and one engaging plane and has elastic restoring feature in the first direction.

3. The lever type connector according to claim 2, further comprising:

temporary holding structure which is provided between the lever and the female connector housing and holds the lever temporarily at a start position of rotation, wherein the temporary holding structure is configured to release temporary holding of the lever when the temporary connecting structure connects the first and second connector housings temporarily.

4. The lever type connector according to claim 3, wherein the temporary holding structure includes a pair of holding projections provided on inner side of the pair of side panels respectively and a pair of holding holes provided on the pair of sidewalls of the first connector housing respectively for engaging the pair of holding projections respectively, the temporary connecting structure includes a pair of projecting tabs projected from the pair of sidewalls of the second connector housing respectively, and the temporary holding structure is configured to release temporary holding of the lever when the pair of projecting tabs pushes the pair of holding projections being engaged with the pair of holding holes outward respectively.

5. The lever type connector according to claim 4, wherein the pair of holding projections includes guiding slopes facing a second direction which is perpendicular to both the connecting direction and the first direction, and the guiding slopes of the pair of holding projections is to be frictioned with the pair of projecting tabs at the initial stage to align a relative position in the second direction between the first and second connector housings.

* * * * *